US011602915B2

(12) United States Patent
Akita et al.

(10) Patent No.: US 11,602,915 B2
(45) Date of Patent: Mar. 14, 2023

(54) SHEET FOLDING DEVICE AND CARTON FOLDER

(71) Applicant: MITSUBISHI HEAVY INDUSTRIES MACHINERY SYSTEMS, LTD., Hyogo (JP)

(72) Inventors: Kazuya Akita, Hiroshima (JP); Shinya Iori, Hiroshima (JP); Makoto Shimohatsubo, Hiroshima (JP)

(73) Assignee: MITSUBISHI HEAVY INDUSTRIES MACHINERY SYSTEMS, LTD., Hyogo (JP)

( * ) Notice: Subject to any disclaimer, the term of this patent is extended or adjusted under 35 U.S.C. 154(b) by 217 days.

(21) Appl. No.: 16/626,933

(22) PCT Filed: Sep. 27, 2017

(86) PCT No.: PCT/JP2017/035051
§ 371 (c)(1),
(2) Date: Dec. 27, 2019

(87) PCT Pub. No.: WO2019/064391
PCT Pub. Date: Apr. 4, 2019

(65) Prior Publication Data

US 2020/0171776 A1 Jun. 4, 2020

(51) Int. Cl.
*B31B 50/58* (2017.01)
*B31B 50/88* (2017.01)

(52) U.S. Cl.
CPC ..... *B31B 50/58* (2017.08); *B31B 50/88* (2017.08)

(58) Field of Classification Search
CPC ..... B31B 50/26; B31B 50/58; B31B 50/59; B31B 50/88
See application file for complete search history.

(56) References Cited

U.S. PATENT DOCUMENTS 4,041,849 A * 8/1977 Tsukasaki ..... B31B 50/262 493/442
4,557,715 A * 12/1985 Robinson ..... B31B 70/00 493/918

(Continued)

FOREIGN PATENT DOCUMENTS

JP 55017700 B2 5/1980
JP S5686128 U 7/1981

(Continued)

OTHER PUBLICATIONS

International Search Report and Written Opinion of International Application No. PCT/JP2017/035051 dated Nov. 7, 2017; 15pp.

*Primary Examiner* — Anna K Kinsaul
*Assistant Examiner* — Luis G Del Valle
(74) *Attorney, Agent, or Firm* — Hauptman Ham, LLP

(57) ABSTRACT

A sheet folding device includes forming belts which are disposed on both sides in a transfer direction of a corrugated board and move to a center side in a width direction of the corrugated board toward a downstream side in the transfer direction to press both end portions in the width direction from an outside so as to bend both the end portions; and a gauge roller group including several gauge rollers which are disposed along the transfer direction and come into contact with outer sides of both bent portions in the width direction of the corrugated board bent by the forming belts. In the several gauge rollers, recessed portions are provided on outer peripheral surfaces of the gauge rollers in a circumferential direction. Positions of the recessed portions are disposed to be offset downward in a vertical direction toward a downstream side in the transfer direction.

6 Claims, 11 Drawing Sheets

(56) References Cited

U.S. PATENT DOCUMENTS

| | | | | |
|---|---|---|---|---|
| 2003/0069118 | A1* | 4/2003 | Trovinger | B65H 45/18 493/429 |
| 2004/0048728 | A1* | 3/2004 | Trovinger | B65H 45/18 493/434 |
| 2015/0024917 | A1* | 1/2015 | Nadachi | B31B 50/54 493/53 |

FOREIGN PATENT DOCUMENTS

| | | | | |
|---|---|---|---|---|
| JP | 2004058665 | A | * | 2/2004 |
| JP | 2004058665 | A | | 2/2004 |
| JP | 2005014411 | A | * | 1/2005 |
| JP | 2013169690 | A | | 9/2013 |

* cited by examiner

SHEET FOLDING DEVICE AND CARTON FOLDER

RELATED APPLICATIONS

The present application is a National Phase of International Application Number PCT/JP2017/035051 filed Sep. 27, 2017.

TECHNICAL FIELD

The present invention relates to a sheet folding device which forms a flat corrugated box by folding a corrugated board while transferring the corrugated board in a process of manufacturing the corrugated box and a carton-forming machine including the sheet folding device.

BACKGROUND ART

A general carton-forming machine manufactures a box body (corrugated box) by processing a sheet material (for example, a corrugated board), and includes a sheet feeding section, a printing section, a slotter creaser section, a die cutting section, a folding section (folder gluer), and a counter-ejector section. In the sheet feeding section, the corrugated boards stacked on a table are fed to the printing section one by one at a constant speed. The printing section includes a printing unit and performs printing on the corrugated board. In the slotter creaser section, creasing lines which become folding lines are formed on the printed corrugated board, and processing of grooves becoming flaps or gluing margin strips for joining is performed. In the die cutting section, punching such as hand hole is performed on the corrugated board on which the creasing lines, the grooves, and gluing margin strips are formed. In the folding section, glue is applied to the gluing margin strip and the corrugated board on which the creasing lines, the grooves, the gluing margin strips, and the hand holes are formed is folded along the creasing lines while the corrugated board moves, and the gluing margin strips are joined to each other to manufacture a flat corrugated box. In addition, in the counter-ejector section, the corrugated boxes in which corrugated boards are folded and glued are stacked, the stacked corrugated boxes are sorted by a predetermined number of batches, and the sorted corrugated boxes are discharged.

In the above-described folding section, folding rails and guide plates are disposed in series along a transfer direction on both sides of the corrugated board in the transfer direction, several gauge rollers are disposed outside the folding rails and guide plates along the transfer direction, and a folding belt and a folding bar are disposed. Accordingly, the corrugated board is transferred while a position in a width direction thereof is restricted by the folding rails and is pressed by the folding belt and the folding bar, and thus, both end portions in the width direction are bent downward. In addition, when both the end portions of the corrugated board in the width direction are bent downward and inward, both bent portions in the width direction are held by the several gauge rollers, and thus, a flat corrugated box is formed.

The sheet folding device of the related art is disclosed in PTL 1 below.

CITATION LIST

Patent Literature

[PTL 1] Japanese Unexamined Patent Application Publication No. 2004-058665

SUMMARY OF INVENTION

Technical Problem

In the above-described sheet folding device, the corrugated board is pressed by the folding belt and the folding bar, and thus, both the end portions in the width direction are bent downward. Accordingly, both the end portions are bent inward while both the bent portions in the width direction are supported by guide surfaces of the several gauge rollers. Each of the several gauge rollers supporting the bent portion of the corrugated board has a rotating shaft along a vertical direction, and a recessed portion is provided along a circumferential direction of the gauge roller. The recessed portion of the gauge roller includes a lower surface along a horizontal direction, an upper surface whose outer peripheral side is inclined downward, and a bottom surface which connects the lower surface and the upper surface and is located along the vertical direction. Accordingly, in the gauge roller, a width (length in vertical direction) of the recessed portion is larger than a thickness of the bent portion of the corrugated board, and thus, the bent portion is fluttered and is not sufficiently supported by the recessed portion. Therefore, in the corrugated board, the bent portion does not have a vertically symmetrical shape, a size of a gap between both the end portions bent inward varies, and thus, quality decreases.

The present invention solves the above-described problems, and an object thereof is to provide a sheet folding device and a carton-forming machine capable of improving bending accuracy of the corrugated board.

Solution to Problem

In order to achieve the object, according to an aspect of the present invention, there is provided a sheet folding device including: forming belts which are disposed on both sides in a transfer direction of a corrugated board and move to a center side in a width direction of the corrugated board toward a downstream side in the transfer direction of the corrugated board to press both end portions in the width direction of the corrugated board from an outside so as to bend both the end portions; and a gauge roller group including several gauge rollers which are disposed along the transfer direction of the corrugated board and come into contact with outer sides of both bent portions in the width direction of the corrugated board bent by the forming belts, in which in the several gauge rollers, recessed portions recessed toward a rotation axis side in a radial direction are provided on outer peripheral surfaces of the gauge rollers in a circumferential direction, and positions of the recessed portions in a direction of the rotation axis at deepest positions are disposed to be offset downward in a vertical direction toward a downstream side in the transfer direction of the corrugated board.

Accordingly, the forming belts move to the center side in the width direction toward the downstream side in the transfer direction of the corrugated board, both the end portions in the width direction of the corrugated board are pressed from the outside to be bent, and in this case, the several gauge rollers support both the bent portions in the width direction of the corrugated board. In this case, while the corrugated board is bent, a position of the bent portion is supported by the recessed portion. Accordingly, a variation in a thickness direction suppressed, a center position of the bent portion in the thickness direction moves downward, and thus, the bent portion is formed to be located at an appropriate position. Therefore, in the corrugated board, the position of the bent portion is close to the intermediate position in the thickness direction, the corrugated board is bent at an appropriate position, and thus, it is possible to improve bending accuracy of the corrugated board.

In the sheet folding device of the present invention, each of the recessed portions has an upper support surface, a lower support surface, and a deepest support surface which connects the upper support surface and the lower support surface to each other, and the upper support surface transitions from a horizontal surface along a horizontal direction to an inclined surface inclined with respect to the horizontal direction at a predetermined transition position at which bending angles of both the end portions in the width direction of the corrugated board are larger than 90°.

Therefore, in the corrugated board, the bent portion comes into contact with the inclined upper support surface to be supported at the predetermined transition position at which the bending angles of both the end portions are larger than 90°. Accordingly, the center position of the bent portion in the thickness direction is regulated to gradually move downward, and thus, the bent portion can be formed at an appropriate position.

In the sheet folding device of the present invention, in the gauge roller which is disposed on the downstream side in the transfer direction of the corrugated board from the predetermined transition position, an inclination angle of the inclined surface is set to a constant angle.

Accordingly, the inclination angles of the upper support surfaces of the gauge rollers disposed on the downstream side from the transition position are the same as each other, and thus, a contact angle with respect to the outer peripheral surface of the bent portion in the corrugated board is constant, and the bent portion can be formed to have an appropriate shape.

In the sheet folding device of the present invention, in the gauge roller which is disposed on the downstream side in the transfer direction of the corrugated board from the predetermined transition position, an inclination angle of the inclined surface is set so as to gradually increase.

Accordingly, the inclination angle of the upper support surface of the gauge roller which is disposed on the downstream side from the transition position has an angle which gradually increases, and thus, the center position in the thickness direction of the bent portion in the corrugated board is gradually regulated to be an appropriate position, and the bent portion can be formed in an appropriate shape.

In the sheet folding device of the present invention, the deepest support surface has a curved surface shape.

Accordingly, since the deepest support surface has the curved surface shape, the recessed portion in the gauge roller can support the bent portion in the corrugated board, the bent portion can be supported by the deepest support surface without a gap, and the bent portion can be formed in an appropriate shape.

The sheet folding device of the present invention further includes a gauge roller adjustment device which adjusts positions of the several gauge rollers in the direction of the rotation axis.

Accordingly, the gauge roller can be adjusted in the direction of the rotation axis by the gauge roller adjustment device. Therefore, the position of the recessed portion in the gauge roller can be adjusted to be an appropriate position according to a type of the corrugated board, and the bent portion can be formed in an appropriate shape regardless of the type of the corrugated board.

In the sheet folding device of the present invention, the gauge roller adjustment device adjusts the positions of the several gauge rollers upward in the vertical direction in the direction of the rotation axis as a thickness of the corrugated board decreases.

Accordingly, the position of the gauge roller can be adjusted upward in the vertical direction as the thickness of the corrugated board decreases. Therefore, when the corrugated board is bent, the recessed portion of the gauge roller can appropriately support the lower surface of the bent portion in the corrugated board, and the bent portion can be formed in an appropriate shape.

Moreover, according to another aspect of the present invention, there is provided a carton-forming machine including: a sheet feeding section which supplies a corrugated board; a printing section which performs printing on the corrugated board; a slotter creaser section which performs creasing line processing and slicing on the printed corrugated board; a folding section which has the sheet folding device; and a counter-ejector section which stacks flat corrugated boxes while counting the flat corrugated boxes, and thereafter, discharges the flat corrugated boxes every predetermined number.

Accordingly, the printing is performed on the corrugated board from the sheet feeding section by the printing section, the creasing line processing and the slicing are performed by the slotter creaser section, the corrugated board is folded by the folding section, end portions of the corrugated board are joined to each other to form a box body, and the box bodies are stacked while being counted by the counter-ejector section. In this case, in the sheet folding device, the forming belts move to the center side in the width direction toward the downstream side in the transfer direction of the corrugated board, both the end portions in the width direction of the corrugated board are pressed from the outside to be bent, and in this case, the several gauge rollers support both the bent portions in the width direction of the corrugated board. In this case, while the corrugated board is bent, a position of the bent portion is supported by the recessed portion. Accordingly, a variation in a thickness direction suppressed, a center position of the bent portion in the thickness direction moves downward, and thus, the bent portion is formed to be located at an appropriate position. Therefore, in the corrugated board, the position of the bent portion is close to the intermediate position in the thickness direction, the corrugated board is bent at an appropriate position, and thus, it is possible to improve bending accuracy of the corrugated board.

Advantageous Effects of Invention

According to the sheet folding device and the carton-forming machine of the present invention, the corrugated board can be bent at an appropriate position, and it is possible to improve bending accuracy of the corrugated board.

BRIEF DESCRIPTION OF DRAWINGS

FIG. 8-1 is a schematic view showing a shape change of the second gauge roller when a thick sheet is folded.

FIG. 8-2 is a schematic view showing the shape change of the second gauge roller when the thick sheet is folded.

FIG. 8-3 is a schematic view showing the shape change of the second gauge roller when the thick sheet is folded.

FIG. 8-4 is a schematic view showing the shape change of the second gauge roller when the thick sheet is folded.

FIG. 9-1 is a schematic view showing a shape change of the second gauge roller when a thin sheet is folded.

FIG. 9-2 is a schematic view showing the shape change of the second gauge roller when the thin sheet is folded.

FIG. 9-3 is a schematic view showing the shape change of the second gauge roller when the thin sheet is folded.

FIG. 9-4 is a schematic view showing the shape change of the second gauge roller when the thin sheet is folded.

FIG. 10-1 is a schematic view showing a modification example of the shape change of the second gauge roller when the thin sheet is folded.

FIG. 10-2 is a schematic view showing a modification example of the shape change of the second gauge roller when the thin sheet is folded.

DESCRIPTION OF EMBODIMENTS

Hereinafter, preferred embodiments of a sheet folding device and a carton-forming machine according to the present invention will be described in detail with reference to the accompanying drawings. In addition, the present invention is not limited by the embodiment, and in a case where several embodiments are provided, the present invention includes those which are obtained by combining the embodiments.

Figure 1:
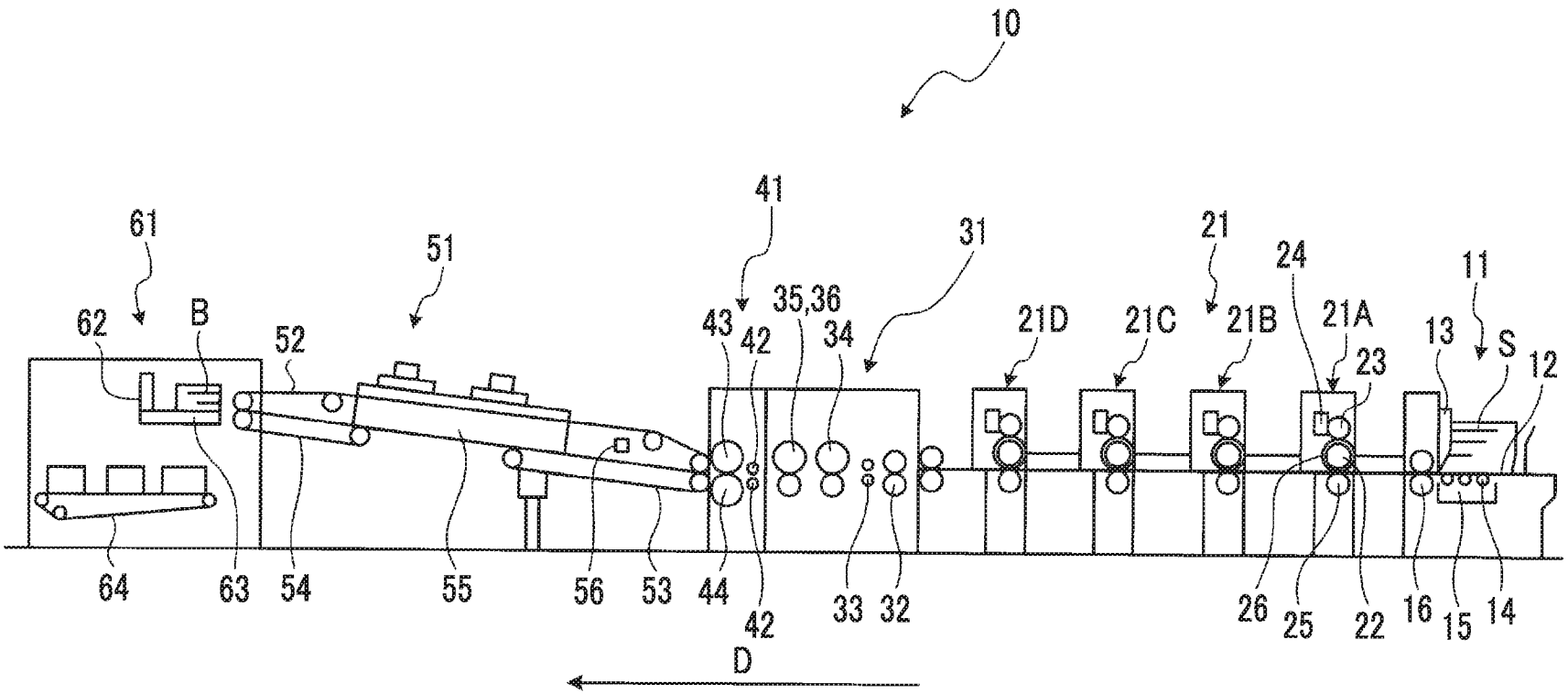
FIG. 1 is a schematic configuration view showing a carton-forming machine of the present embodiment.
Figure 2:
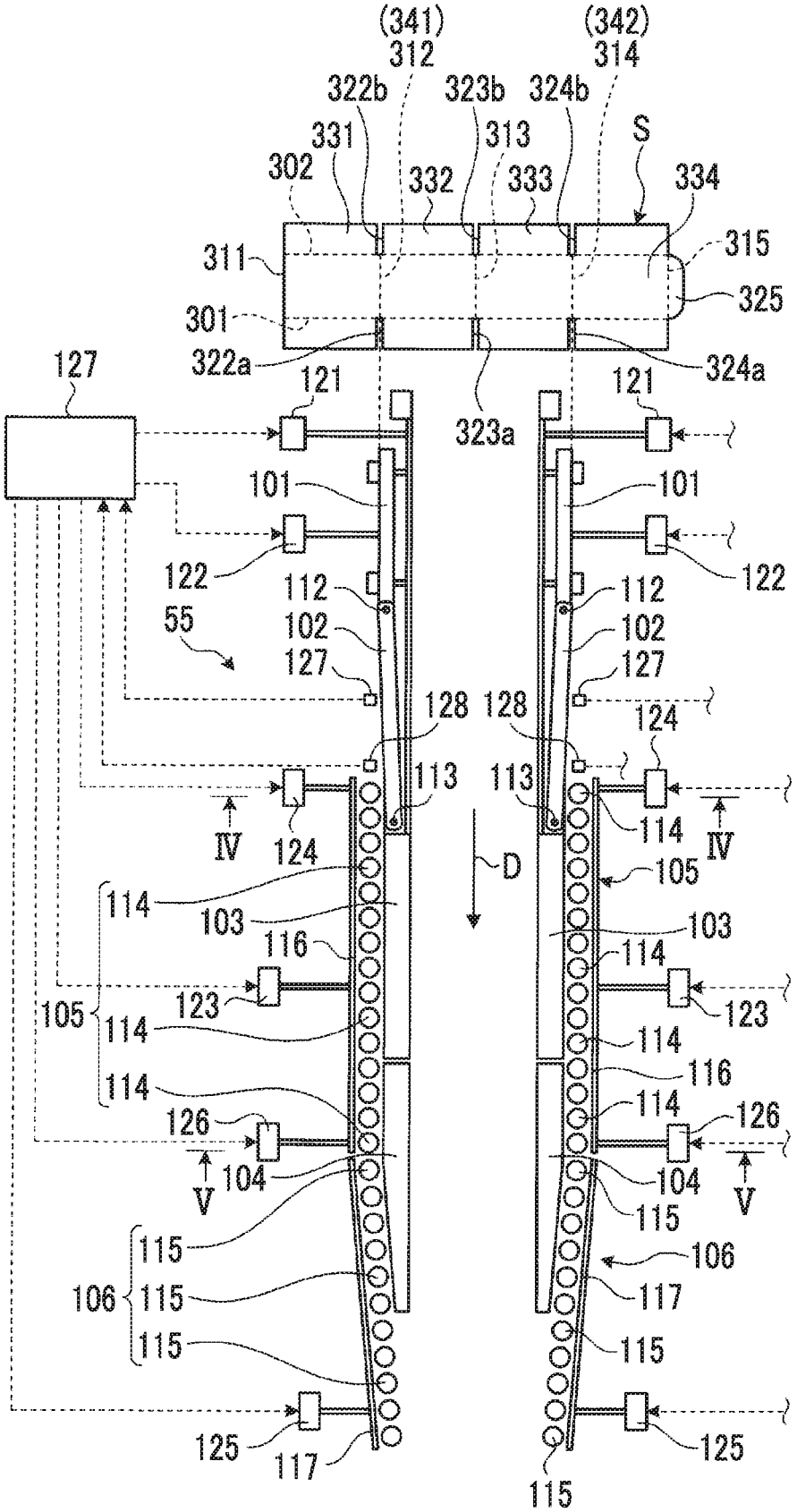
FIG. 2 is a schematic plan view showing a sheet folding device of the present embodiment.
Figure 3:
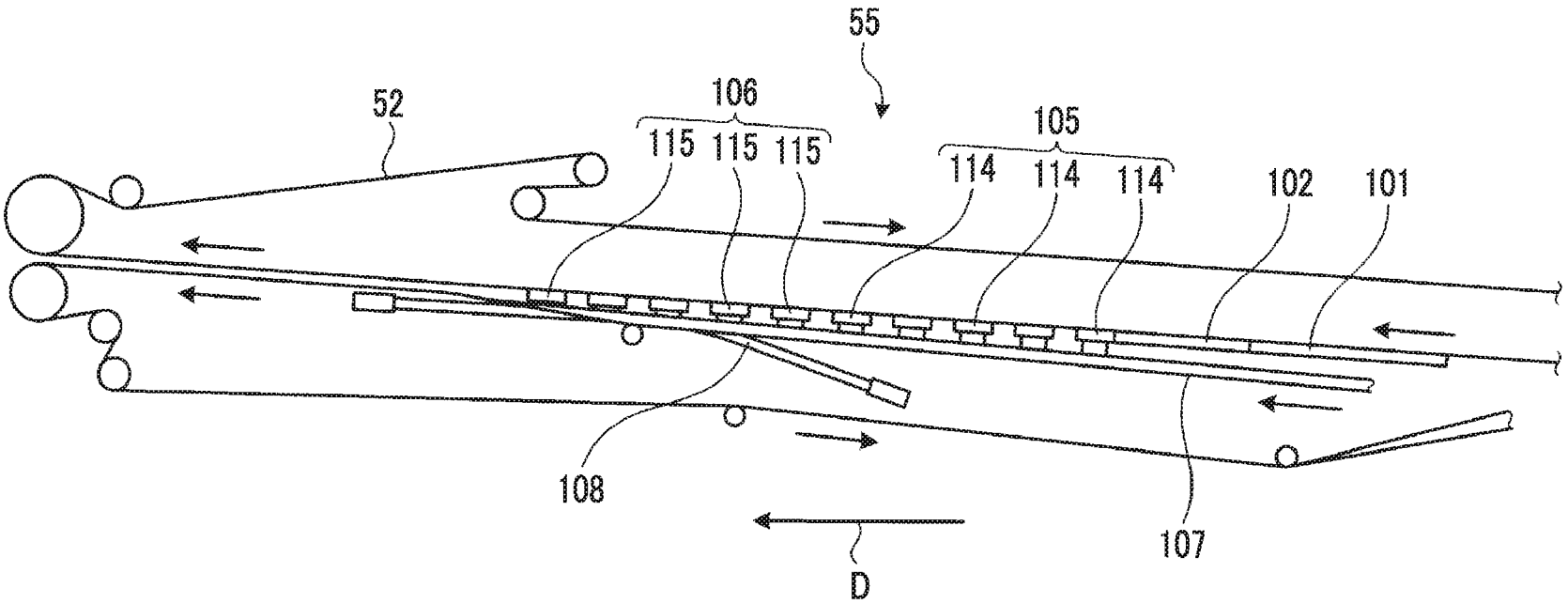
FIG. 3 is a schematic side view showing the sheet folding device.
Figure 4:
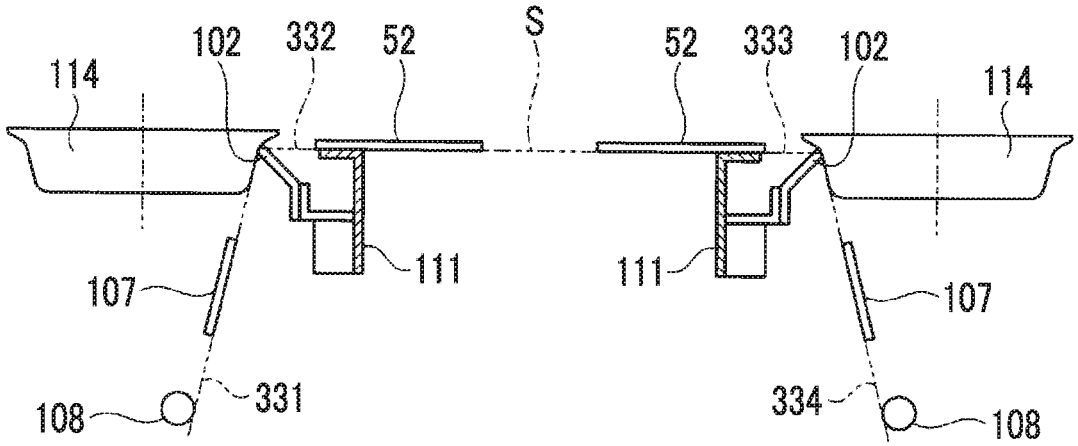
FIG. 4 is a sectional view of a first gauge roller group taken along line IV-IV of FIG. 2.
Figure 5:
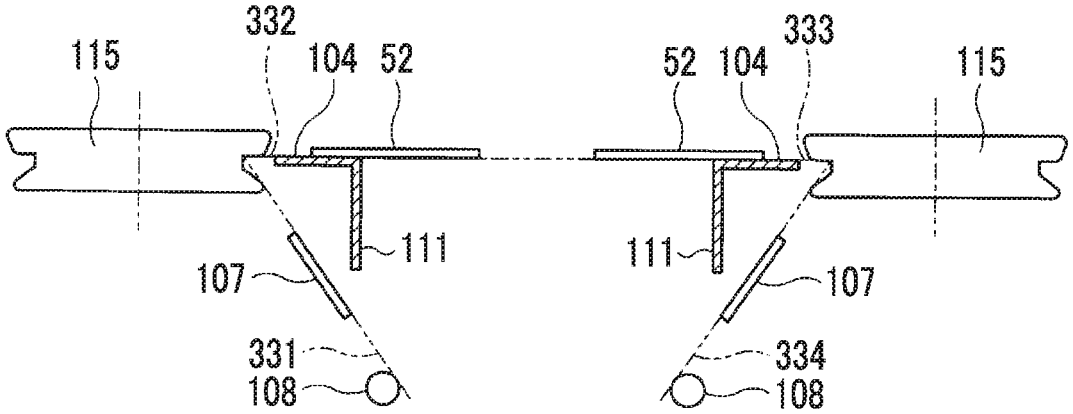
FIG. 5 is a sectional view of a second gauge roller group taken along line V-V of FIG. 2.

FIG. 1 is a schematic configuration view showing a carton-forming machine of the present embodiment, FIG. 2 is a schematic plan view showing a sheet folding device of the present embodiment, FIG. 3 is a schematic side view showing the sheet folding device, FIG. 4 is a sectional view of a first gauge roller group taken along line IV-IV of FIG. 2, and FIG. 5 is a sectional view of a second gauge roller group taken along line V-V of FIG. 2.

In the present embodiment, as shown in FIG. 1, a carton-forming machine 10 manufactures a corrugated box (box body) B by processing a corrugated board S. The carton-forming machine 10 includes a sheet feeding section 11, a printing section 21, a slotter creaser section 31, a die cutting section 41, a folding section 51, a counter-ejector section 61 which are linearly disposed in a transfer direction D in which the corrugated board S and the corrugated box B are transferred.

In the sheet feeding section 11, the corrugated boards S are fed to the printing section 21 one by one at a constant speed. The sheet feeding section 11 includes a table 12, a front stopper 13, supply rollers 14, a suction unit 15, and a feed roll 16. Several corrugated boards S are placed on the table 12 so as to be stacked, and the table 12 is supported so as to be lifted and lowered. The front stopper 13 can position a front end position of each of the corrugated boards S stacked on the table 12, and a gap which allows one corrugated board S to pass through a portion between a lower end portion of the front stopper 13 and the table 12 is secured. Several supply rollers 14 are disposed corresponding to the table 12 in the transfer direction D of the corrugated board S. When the table 12 is lowered, the corrugated board S located at the lowermost position of several stacked corrugated boards S can be fed forward by the supply rollers 14. The stacked corrugated boards S are suctioned downward, that is, toward the table 12 side or the supply roller 14 side by the suction unit 15. The feed roll 16 can supply the corrugated board S fed by the supply rollers 14 to the printing section 21.

The printing section 21 performs multi-color printing (in the first embodiment, four-color printing) on a surface of the corrugated board S. In the printing section 21, four printing units 21A, 21B, 21C, and 21D are disposed in series, and printing can be performed on the surface of the corrugated board S using four ink colors. The printing units 21A, 21B, 21C, and 21D are approximately similarly configured to each other, and each of the printing units 21A, 21B, 21C, and 21D includes a printing cylinder 22, an ink supply roll (anilox roll) 23, an ink chamber 24, and a receiving roll 25. A printing die 26 is mounted on an outer peripheral portion of the printing cylinder 22, and the printing cylinder 22 is rotatably provided. The ink supply roll 23 is disposed so as to contact against the printing die 26 in the vicinity of the printing cylinder 22, and is rotatably provided. The ink chamber 24 stores ink and is provided in the vicinity of the ink supply roll 23. The corrugated board S is interposed between the receiving roll 25 and the printing cylinder 22, the receiving roll 25 transfers the corrugated board S while applying a predetermined printing pressure to the corrugated board S, and the receiving roll 25 is rotatably provided so as to face a lower portion of the printing cylinder 22. In addition, although not shown, a pair of upper and lower feed rolls is provided in front of and behind each of the printing units 21A, 21B, 21C, and 21D.

In the slotter creaser section 31, creasing line processing, cutting, slicing, and gluing margin strip processing are performed on the corrugated board S. The slotter creaser section 31 includes first creasing line rolls 32, second creasing line rolls 33, first slotter heads 34, second slotter heads 35, and slitter heads 36. The first creasing line rolls 32 and the second creasing line rolls 33 perform the creasing line processing on a rear surface (lower surface) of the corrugated board S. The first slotter head 34 and the second slotter heads 35 perform the slicing on the corrugated board S at a predetermined position and performs the gluing margin strip processing on the corrugated board S. The slitter heads 36 are provided to be adjacent to the second slotter heads 35 and cut an end portion in a width direction of the corrugated board S.

In the die cutting section 41, punching such as forming a hand hole is performed on the corrugated board S. The die cutting section 41 includes a pair of upper and lower feeding pieces 42, an anvil cylinder 43, and a knife cylinder 44. The feeding pieces 42 are rotatably provided such that the corrugated board S is transferred in a state where the corrugated board S is interposed between the upper portion and the lower portion. Each of the anvil cylinder 43 and the knife cylinder 44 is circularly formed, and the anvil cylinder 43 and the knife cylinder 44 are rotatable in synchronization with each other by a drive device (not shown). A blade attachment base (punching blade) is attached to the knife cylinder 44 at a predetermined position of an outer peripheral portion of the knife cylinder 44 while an anvil is formed on an outer peripheral portion of the anvil cylinder 43.

In the folding section 51, the corrugated board S is folded while being moved in the transfer direction D, and both end portions in the width direction of the corrugated board S are joined to each other so as to form a flat corrugated box B. The folding section 51 includes an upper transfer belt 52, lower transfer belts 53 and 54, and a sheet folding device (folder gluer) 55. The upper transfer belt 52 and the lower transfer belts 53 and 54 transfer the corrugated board S and the corrugated box B in a state where the corrugated board S and the corrugated box B are interposed between the upper portion and the lower portion. Although the sheet folding device 55 will be described later, the sheet folding device 55 folds each end portion in the width direction of the corrugated board S while bending the end portion downward. In addition, the folding section 51 includes a gluing device 56. The gluing device 56 includes a glue gun, the glue is ejected at a predetermined timing by the glue gun, and gluing can be applied to a predetermined position of the corrugated board S.

In the counter-ejector section 61, after the corrugated boxes B are stacked while being counted, the corrugated boxes B are sorted by a predetermined number of batches, and thereafter, the sorted corrugated boxes B are discharged. The counter-ejector section 61 includes a hopper device 62. The hopper device 62 includes an elevator 63 on which corrugated boxes B are stacked and which can be lifted and lowered, and a front stopper and an angle arrangement plate are provided in the elevator 63. In addition, an ejection conveyor 64 is provided below the hopper device 62.

The corrugated board S is formed by gluing a medium forming a waveform between a front liner and a top liner. As shown in FIG. 2, in the corrugated board S, two folding lines 301 and 302 are formed in a pre-process of the carton-forming machine 10. The folding lines 301 and 302 are used for folding a flap when the corrugated box B manufactured by the carton-forming machine 10 is assembled later. As shown in FIG. 1, the corrugated boards S are stacked on the table 12 of the sheet feeding section 11.

In the sheet feeding section 11, first, the several corrugated boards S stacked on the table 12 are positioned by the front stopper 13, and thereafter, the table 12 is lowered, and the corrugated board S positioned at the lowermost position is fed by the several supply rollers 14. Accordingly, the corrugated board S is supplied to the printing section 21 on a predetermined constant side by the pair of feed rolls 16.

In the printing section 21, ink is supplied from the ink chamber 24 to the surface of the ink supply roll 23 in each of the printing units 21A, 21B, 21C, and 21D, and if the printing cylinder 22 and the ink supply roll 23 rotate, the ink on the surface of the ink supply roll 23 is transferred to the printing die 26. Moreover, if the corrugated board S is transferred to a portion between the printing cylinder 22 and the receiving roll 25, the corrugated board S is interposed between the printing die 26 and the receiving roll 25, and a printing pressure is applied to the corrugated board S so as to perform printing on the surface of the corrugated board S. The printed corrugated board S is transferred to the slotter creaser section 31 by the feed rolls.

In the slotter creaser section 31, first, when the corrugated board S passes through the first creasing line rolls 32, as shown in FIG. 2, creasing lines 312, 313, 314, and 315 are formed on the rear surface (top liner) side of the corrugated board S. In addition, when the corrugated board S passes through the second creasing line rolls 33, the creasing lines 312, 313, 314, and 315 are formed on the rear surface (top liner) side of the corrugated board S again.

Next, when the corrugated board S in which the creasing lines 312, 313, 314, and 315 are formed passes through the first and second slotter heads 34 and 35, grooves 322*a*, 322*b*, 323*a*, 323*b*, 324*a*, and 324*b* are formed at the positions of the creasing lines 312, 313, and 314. In this case, an end portion is cut at the position of the creasing line 315, and a gluing margin strip 325 is formed. In addition, when the corrugated board S passes through the slitter heads 36, an end portion is cut at a position of a cutting position 311. Accordingly, the corrugated board S includes four sheet pieces 331, 332, 333, and 334 which have the creasing lines 312, 313, and 314 (grooves 322*a*, 322*b*, 323*a*, 323*b*, 324*a*, and 324*b*) as boundaries.

In the die cutting section 41, when the corrugated board S passes through a portion between the anvil cylinder 43 and the knife cylinder 44, a hand hole (not shown) is formed. However, since the hand hole processing is appropriately performed according to the kind of the corrugated board S, when the hand hole is not required, a blade attachment base (punching blade) for performing the hand hole processing is removed from the knife cylinder 44, and the corrugated board S passes through the portion between the rotating anvil cylinder 43 and knife cylinder 44. In addition, the corrugated board S in which the hand hole is formed is transferred to the folding section 51.

In the folding section 51, glue is applied to the gluing margin strip 325 (refer to FIG. 2) by the gluing device 56 while the corrugated board S is moved in the transfer direction D by the upper transfer belt 52 and the lower transfer belts 53 and 54, and thereafter, the corrugated boards S is folded downward by the sheet folding device 55 with the creasing lines 312 and 314 (refer to FIG. 2) as base points. If this folding advances to nearly 180°, the folding force becomes stronger, the gluing margin strip 325 and the end portion of the corrugated board S are pressed to each other so as to come into close contact with each other, both the end portions of the corrugated board S are joined to each other, and the corrugated box B is formed. In addition, the corrugated box B is transferred to the counter-ejector section 61.

In the counter-ejector section 61, the corrugated box B is fed to the hopper device 62, a distal end portion of the corrugated box B in the transfer direction D abuts against the front stopper, and the corrugated boxes B are stacked on the elevator 63 in a state of being arranged by the angle arrangement plate. In addition, if a predetermined number of corrugated boxes B are stacked on the elevator 63, the elevator 63 is lowered, a predetermined number of corrugated boxes B become one batch, are discharged by the ejection conveyor 64, and are fed to the post-process of the carton-forming machine 10.

Here, the sheet folding device 55 of the present embodiment will be described in detail.

As shown in FIGS. 2 to 5, the sheet folding device 55 includes first folding rails 101, second folding rails 102, first guide plates 103, second guide plates 104, first gauge roller groups 105, second gauge roller groups 106, forming belts 107, and folding bars 108.

A pair of right and left upper transfer belts 52 is provided on an upper side in a vertical direction, and is provided over the entire length of the sheet folding device 55 in the transfer direction D. Each upper transfer belt 52 is an endless belt and is configured to be wound around several pulleys supported by a pair of right and left upper frames (not shown) so that the upper transfer belt 52 can circulate. In each of the circulating upper transfer belts 52, a lower side thereof moves in the transfer direction D and an upper side thereof moves in a direction opposite to the transfer direction D.

A pair of right and left lower frames 111 facing the pair of right and left upper frames is provided vertically below the pair of right and left upper frames, and the pair of right and left upper transfer belts 52 is disposed to face the pair of right and left lower frames 111 above the pair of right and left lower frames 111. A pair of right and left first folding rails 101 and a pair of right and left second folding rails 102 are disposed in series along the transfer direction D on both sides in the transfer direction D of the corrugated board S. The respective first folding rails 101 and the respective second folding rails 102 are supported outside the pair of right and left lower frames 111. The respective first folding rails 101 are disposed to be approximately parallel in the transfer direction D, and the respective second folding rails 102 are disposed to be inclined such that downstream sides of the respective second folding rails 102 in the transfer direction D approach each other. In addition, downstream end portions of the respective first folding rails 101 in the transfer direction D are rotatably connected horizontally to upstream end portions of the respective second folding rails 102 in the transfer direction D by respective connection shafts 112 along the vertical direction. In addition, downstream end portions of the respective second folding rail 102 in the transfer direction D are rotatably connected horizontally to the lower frames 111 by respective connection shafts 113 along the vertical direction.

In the respective first folding rails 101 and the respective second folding rails 102, positions in a width direction in both the side portions along the transfer direction D are disposed at positions in the width direction corresponding to the respective creasing lines 312 and 314 on a lower surface of the corrugated board S transferred in the transfer direction D. Accordingly, the corrugated board S is transferred while sheet pieces 331 and 334 on end portion sides in the width direction are folded downward with respect to respective sheet pieces 332 and 333 on a center side in the width direction at positions at which the respective creasing lines 312 and 314 abut against both sides of the respective first folding rails 101 and the respective second folding rails 102, and thus, bent portions 341 and 342 are formed at the respective creasing lines 312 and 314.

A pair of right and left first guide plates 103 and a pair of right and left second guide plates 104 are disposed in series along the transfer direction D on both the sides in the transfer direction D of the corrugated board S. The respective first guide plates 103 and the respective second guide plates 104 are disposed in series along the transfer direction D on the downstream sides of the respective second folding rails 102 in the transfer direction D. The respective first guide plates 103 and the respective second guide plates 104 are supported outside the pair of right and left lower frames 111. The respective first guide plates 103 are disposed to be approximately parallel in the transfer direction D, and the respective second guide plates 104 are disposed to be approximately parallel in the transfer direction D. However, downstream outer surface of the second guide plates 104 in the transfer direction D are formed in inclined surfaces.

In the respective first guide plates 103 and the respective second guide plates 104, positions in a width direction in both the side portions along the transfer direction D are disposed at positions in the width direction corresponding to the respective creasing lines 312 and 314 on the lower surface of the corrugated board S transferred in the transfer direction D. Accordingly, the corrugated board S is transferred while the sheet pieces 331 and 334 on the end portion sides in the width direction are folded downward with respect to the respective sheet pieces 332 and 333 on a center side in the width direction at positions at which the respective creasing lines 312 and 314 (bent portions 341 and 342) abut against both the side portions of the respective first guide plates 103 and the respective second guide plates 104.

A pair of right and left first gauge roller groups 105 and a pair of right and left second gauge roller groups 106 are disposed in series along the transfer direction D on both the sides in the transfer direction D of the corrugated board S. The respective first gauge roller groups 105 and the respective second gauge roller groups 106 are disposed so as to face each other outside the respective second folding rails 102, the respective first guide plates 103, and the respective second guide plates 104 in the width direction. The respective first gauge roller groups 105 include several first gauge rollers 114 and the respective second gauge roller groups 106 includes several second gauge rollers 115. The respective gauge rollers 114 and 115 are rotatably supported by support plates 116 and 117 in rotation axes along the vertical direction, and the respective support plates 116 and 117 are supported outside the respective lower frames 111. In addition, the respective gauge rollers 114 and 115 can be driven and rotated synchronously by a drive device (not shown).

Although described later, each first gauge roller 114 of the first gauge roller groups 105 and each second gauge roller 115 of the second gauge roller groups 106 include recessed portions on outer peripheral portions in the circumferential direction. In the respective first gauge rollers 114 and the respective second gauge rollers 115, positions of the recessed portions in the width direction are disposed at positions in the width direction corresponding to the respective creasing lines 312 and 314 (bent portions 341 and 342) on the lower surface of the corrugated board S transferred in the transfer direction D. In addition, shapes of the recessed portions in the respective first gauge roller groups 105 and the respective second gauge roller groups 106 are changed according to bending angles of the sheet pieces 331 and 334 on the end portion side in the width direction with respect to the respective sheet pieces 332 and 333 on the center side in the width direction. Accordingly, after the corrugated board S is bent downward at the positions of the respective creasing lines 312 and 314, outer peripheral portions of the bent portions 341 and 342 is supported by the recessed portions of the respective first gauge roller 114 and the respective second gauge roller 115, and thus, the corrugated board S is transferred while the sheet pieces 331 and 334 on the end portion sides in the width direction are folded with respect to the respective sheet pieces 332 and 333 on the center side in the width direction.

A pair of right and left forming belts 107 are provided in the transfer direction D on the downstream side of the lower transfer belt 53 (refer to FIG. 1) in the transfer direction D. Each forming belt 107 is an endless belt and is configured to be wound around several pulleys (not shown) supported by each lower frame 111 so that the forming belt 107 can circulate. In each of the circulating forming belts 107, an upper side thereof moves in the transfer direction D and a lower side thereof moves in a direction opposite to the transfer direction D. The respective forming belts 107 are inclined so as to be twisted in the transfer direction D such that the respective forming belts 107 come into contact with outer surfaces (upper surfaces) of the respective sheet pieces 331 and 334 formed by bending both the end portions in the width direction of the corrugated board S downward so as to face the outer surfaces. Accordingly, when the corrugated board S is transferred while being supported by the respective folding rails 101 and 102, the respective guide plates 103 and 104, and the respective gauge roller groups 105 and 106, the respective forming belts 107 fold the sheet pieces 331 and 334 on the end side in the width direction while pressing the sheet pieces 331 and 334 downward and inward in order.

A pair of right and left folding bars 108 are provided on the downstream side in the transfer direction D, and a portion of each folding bar 108 is provided to overlap the second guide plate 104, the first gauge roller group 105, the second gauge roller group 106, and the forming belt 107 in the transfer direction D. Similarly to the respective forming belts 107, the respective folding bars 108 are provided so as to face and come into contact with the outer surfaces (the upper surfaces) of the respective sheet pieces 331 and 334 formed by bending both the end portions in the width direction of the corrugated board S downward. Accordingly, when the corrugated board S is transferred while being supported by the respective folding rails 101 and 102, the respective guide plates 103 and 104, and the respective gauge roller groups 105 and 106, the respective folding bars 108 press the sheet pieces 331 and 334 on the end side in the width direction downward and inward in order, in cooperation with the respective forming belts 107.

In addition, a first folding rail adjustment device 121 and a second folding rail adjustment device 122 are provided, which adjust the position of each of the folding rails 101 and 102 in the width direction of the corrugated board S. The first folding rail adjustment device 121 moves the first folding rail 101 and the second folding rail 102 in parallel in the width direction of the corrugated board S so as to adjust the positions in the width direction in a state of maintaining angles of the first folding rail 101 and the second folding rail 102 in the transfer direction D. The second folding rail adjustment device 122 moves the first folding rail 101 in parallel in the width direction of the corrugated board S so as to adjust the position in the width direction in a state of maintaining the angle of the first folding rail 101 in the transfer direction D. In this case, the second folding rail adjustment device 122 moves the first folding rail 101 in the width direction of the corrugated board S, and thus, the second folding rail adjustment device 122 moves the connection shaft 112 side in the width direction of the corrugated board S with the connection shaft 113 of the second folding rail 102 as a supporting point and can adjust the position of the second folding rail 102 in the width direction and the angle of the second folding rail 102.

In addition, first gauge roller adjustment devices 123, second gauge roller adjustment devices 124, and third gauge roller adjustment devices 125 are provided, which adjust the positions of the respective gauge roller groups 105 and 106 in the width direction of the corrugated board S. The first gauge roller adjustment device 123 moves the first gauge roller group 105 in parallel in the width direction of the corrugated board S so as to adjust the position in the width direction in a state of maintaining an angle of the first gauge roller group 105 in the transfer direction D. The second gauge roller adjustment device 124 moves the gauge roller 114 on the upstream side of the first gauge roller group 105 in the transfer direction D in the width direction of the corrugated board S with the gauge roller 114 (or, in the vicinity of) on the downstream side of the first gauge roller group 105 in the transfer direction D as a supporting point and adjusts an angle of the first gauge roller group 105. The third gauge roller adjustment device 125 moves the second gauge roller 115 on the downstream side of the second gauge roller group 106 in the transfer direction D in the width direction of the corrugated board S with the gauge roller 115 on the upstream side of the second gauge roller group 106 in the transfer direction D as a supporting point and adjusts an angle of the second gauge roller group 106.

Moreover, gauge roller vertical adjustment devices (gauge roller adjustment devices) 126 are provided, which adjust a position in a thickness direction of the corrugated board S in the respective gauge roller groups 105 and 106. The gauge roller vertical adjustment devices 126 moves the respective gauge roller groups 105 and 106 in parallel in the thickness direction of the corrugated board S so as to adjust the position in the thickness direction in a state of maintaining angles of the respective gauge roller groups 105 and 106 in the transfer direction D.

The first folding rail adjustment device 121, the second folding rail adjustment device 122, the first gauge roller adjustment device 123, the second gauge roller adjustment device 124, the third gauge roller adjustment device 125, and the gauge roller vertical adjustment device 126 have substantially the same configuration. Here, the gauge roller vertical adjustment device 126 will be described as an example.

Figure 6:
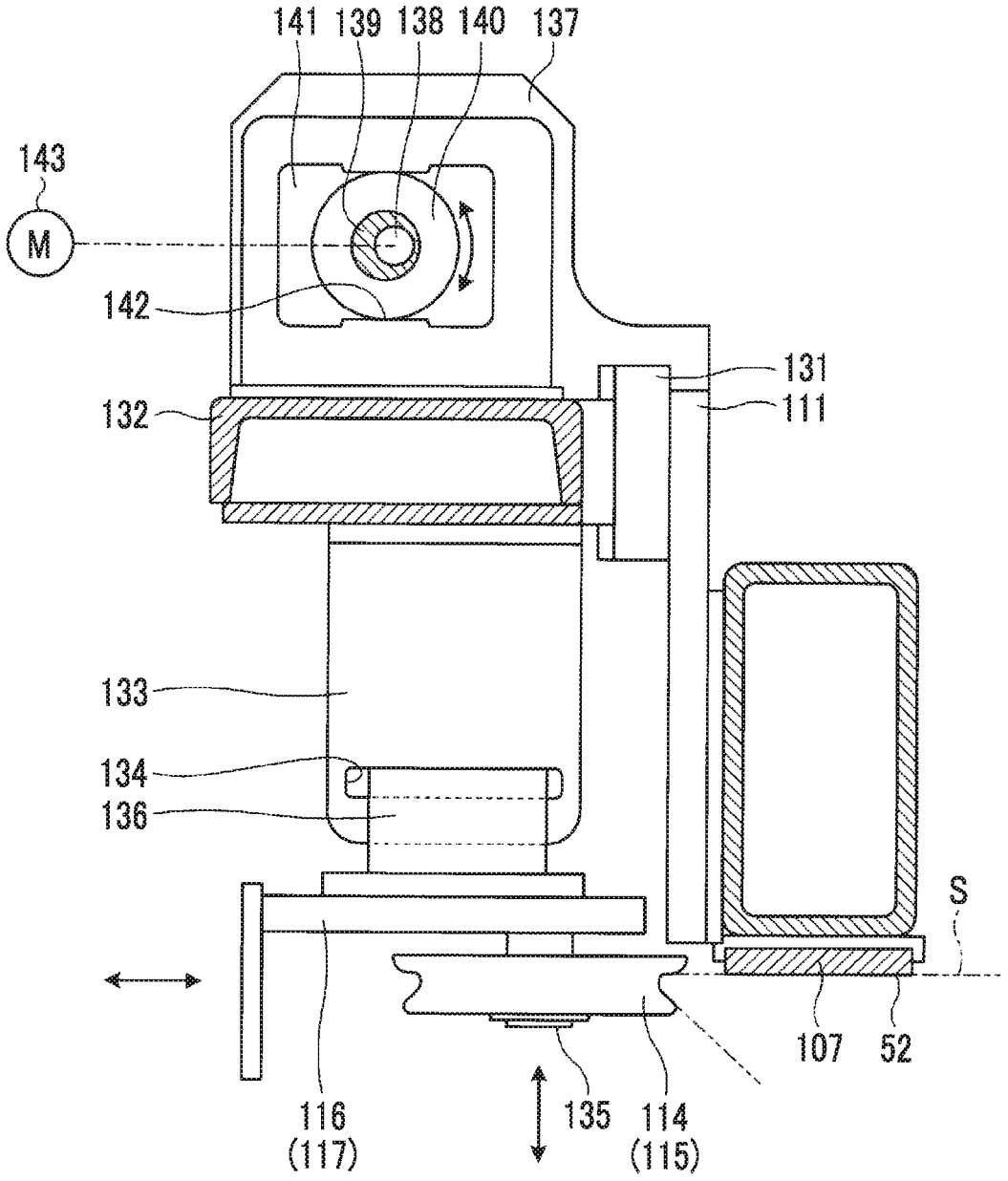
FIG. 6 is a schematic view showing a gauge roller vertical position adjustment device.

FIG. 6 is a schematic view showing the gauge roller vertical position adjustment device.

As shown in FIG. 6, a guide rail 131 is fixed to a lower frame 111. A lifting/lowering frame 132 is supported by the guide rail 131 to be movable along the vertical direction (rotation axis direction of each of gauge rollers 114 and 115). In addition, the lifting/lowering frame 132 is fixed such that a support piece 133 hangs down, and a guide hole 134 is formed in the support piece 133 along the width direction of the corrugated board S. The gauge rollers 114 and 115 are rotatably supported by the rotating shafts 135 along the vertical direction in the support plates 116 and 117. In addition, an integral connection piece 136 is fitted into the guide hole 134 of the support piece 133, and thus, the support plates 116 and 117 are supported to be movable along the width direction of the corrugated board S.

Moreover, a bearing portion 137 is disposed above the lifting/lowering frame 132 and is fixed to the lower frame 111. In the bearing portion 137, a rotating shaft 138 is rotatably supported along the transfer direction D (direction orthogonal to a paper surface of FIG. 6) of the corrugated board S, and an eccentric rotating body 140 is fixed to the rotating shaft 138 via an eccentric portion 139. Axes of the rotating shaft 138 and the eccentric rotating body 140 are offset from each other by a predetermined distance. A connection portion 141 is fixed to an upper portion of the lifting/lowering frame 132, and an opening portion 142 is formed. The bearing portion 137 and the connection portion 141 face each other in the transfer direction D of the corrugated board S, and the eccentric rotating body 140 is in contact with upper and lower surfaces of the opening portion 142. Moreover, the rotating shaft 138 is made to be rotatable by a drive device 143.

Accordingly, if the eccentric rotating body 140 is rotated by a predetermined angle via the rotating shaft 138 by the drive device 143, the eccentric rotating body 140 oscillates with respect to the rotating shaft 138. Therefore, the lifting/lowering frame 132 moves along the vertical direction via the connection portion 141 by an amount of axial misalignment between the rotating shaft 138 and the eccentric rotating body 140. If the lifting/lowering frame 132 moves along the vertical direction, the gauge roller 114 (115) which is supported by the lifting/lowering frame 132 by the support piece 133, the guide hole 134, and the connection piece 136 moves along the thickness/width direction (vertical direction) of the corrugated board S. The gauge roller vertical adjustment device 126 specifies a rotation position of the eccentric rotating body 140 by the drive device 143, and thus, moves the gauge roller 114 (115) in the thickness direction of the corrugated board S, and can adjust the position in the thickness direction.

In addition, the gauge roller vertical adjustment device 126 specifies the rotation position of the eccentric rotating body 140 by the drive device 143, and thus, moves the gauge roller 114 (115) in the thickness direction of the corrugated board S, and can adjust the position in the thickness direction. However, although not shown, the respective folding rail adjustment devices 121 and 122 specify the rotation position of the eccentric rotating body by the drive device, and thus, move the folding rails 101 and 102 at the width positions of the corrugated board S, and can adjust the positions. Moreover, although not shown, the respective gauge roller adjustment devices 123, 124, and 125 specify the rotation position of the eccentric rotating body by the drive device, and thus, move the gauge roller 114 (115) in the width direction of the corrugated board S, and can adjust the position. For example, the first gauge roller adjustment device 123 can move the support plates 116 and 117 in the width direction of the corrugated board S.

As shown in FIG. 2, a controller 127 is connected to the first folding rail adjustment devices 121, the second folding rail adjustment devices 122, the first gauge roller adjustment devices 123, the second gauge roller adjustment devices 124, the third gauge roller adjustment devices 125, and the gauge roller vertical adjustment devices 126. The controller 127 drives and controls the respective adjustment devices 121, 122, 123, 124, 125, 126 according to the shape, size, thickness, or the like of the corrugated board S.

Accordingly, as shown in FIGS. 2 to 5, if the corrugated board S on which the creasing lines 312, 313, and 314 are formed is guided by the upper transfer belt 52 and the lower transfer belt 53 and reaches the first folding rails 101, the corrugated board S is transferred such that the respective creasing lines 312 and 314 abut against both the side portions of the respective first folding rails 101. In addition, in a process in which the corrugated board S is transferred on the respective first folding rails 101 and the respective second folding rails 102, the respective forming belt 107 press the sheet pieces 331 and 334 on the end portion sides in the width direction of the corrugated board downward, and the respective folding bars 108 press the sheet pieces 331 and 334 downward on the end portion sides in the width direction downward in cooperation with the respective forming belts 107.

Accordingly, in the corrugated board S, the sheet pieces 331 and 334 on the end portion sides in the width direction are bent downward with respect to the sheet pieces 332 and 333 on the center side in the width direction at positions at which the respective creasing lines 312 and 314 abut against both the side portions of the respective first folding rails 101 or the respective second folding rails 102, and thus, the bent portions 341 and 342 are formed. Moreover, in a process in which the corrugated board S is transferred to the respective first guide plates 103 or the respective second guide plates 104, outer peripheral portions of the bent portions 341 and 342 between the respective sheet pieces 332 and 333 and the respective sheet pieces 331 and 334 come into contact with the recessed portions of the respective gauge rollers 114 and 115 in the respective first gauge roller groups 105 and the respective second gauge roller groups 106 to be supported. As a result, in the corrugated board S, the sheet pieces 331 and 334 on the end portion sides in the width direction are folded until the sheet pieces 331 and 334 come into contact with the respective sheet pieces 332 and 333 on the center side in the width direction, and thus, the corrugated box B having a flat shape is formed.

Meanwhile, in the corrugated board S, when the sheet pieces 331 and 334 on the end portion sides in the width direction are pressed downward to be folded by the forming belts 107 and the folding bars 108, the outer peripheral portions of the bent portions 341 and 342 come into contact with the outer peripheral surfaces of the first gauge rollers 114 to be supported from when the bending angle is approximately 70°, the outer peripheral portions of the bent portions 341 and 342 come into contact with the outer peripheral surfaces of the second gauge rollers 115 to be supported from when the bending angle is approximately 115°, and the outer peripheral portions are bent until the bending angle becomes 180°. In this case, in the corrugated box B folded to have a flat shape, it is preferable that gaps of the distal end portions of the sheet pieces 331 and 334 on the end portion sides in the width direction are constant (preset predetermined length). Accordingly, it is necessary that the positions of the bent portions 341 and 342 in the corrugated board S (corrugated box B) are positioned at intermediate positions in the thickness direction between the sheet pieces 332 and 333 on the center side in the width direction and the sheet pieces 331 and 334 on the end portion sides in the width direction. That is, in the folded corrugated board S (corrugated box B having a flat shape), the bent portions 341 and 342 are formed in a vertically symmetrical shape, and thus, quality thereof is improved.

Accordingly, in the sheet folding device of the present embodiment, in the second gauge roller group 106, a recessed portion 151 (refer to FIG. 7 described later) recessed toward a rotation axis side in a radial direction is circumferentially provided on au outer peripheral surface of each of the several second gauge rollers 115, and a position of the recessed portion 151 in a direction of the rotation axis O at a deepest position P is disposed to be offset downward in the vertical direction toward the downstream side in the transfer direction D of the corrugated board S.

Figure 7:
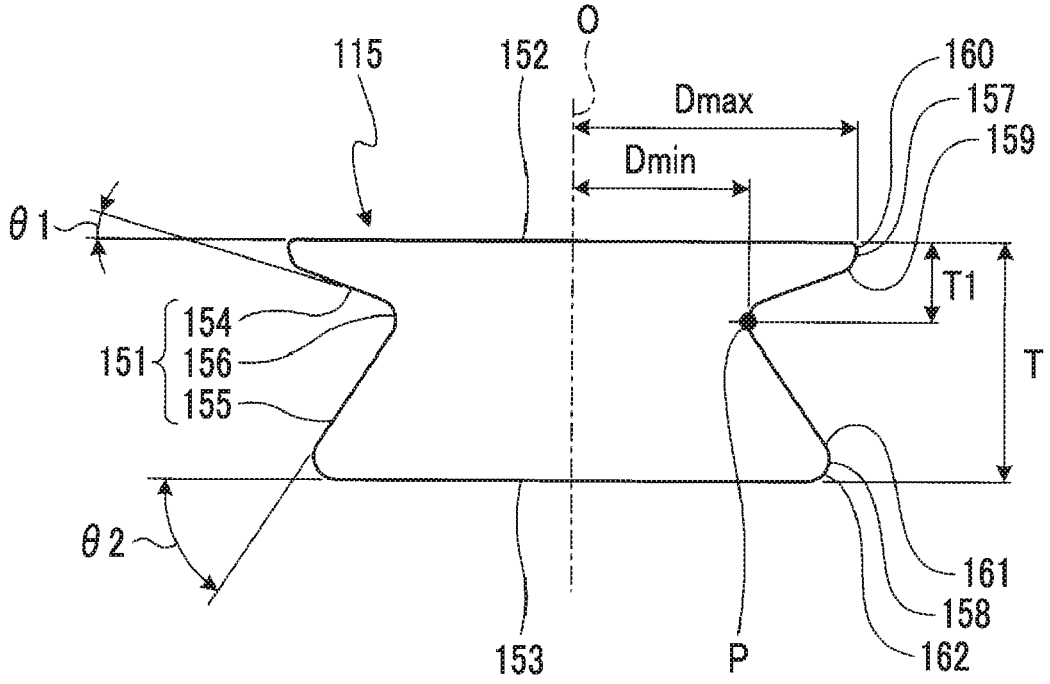
FIG. 7 is an explanatory view for explaining a shape of a second gauge roller.
Figures 1, 8:
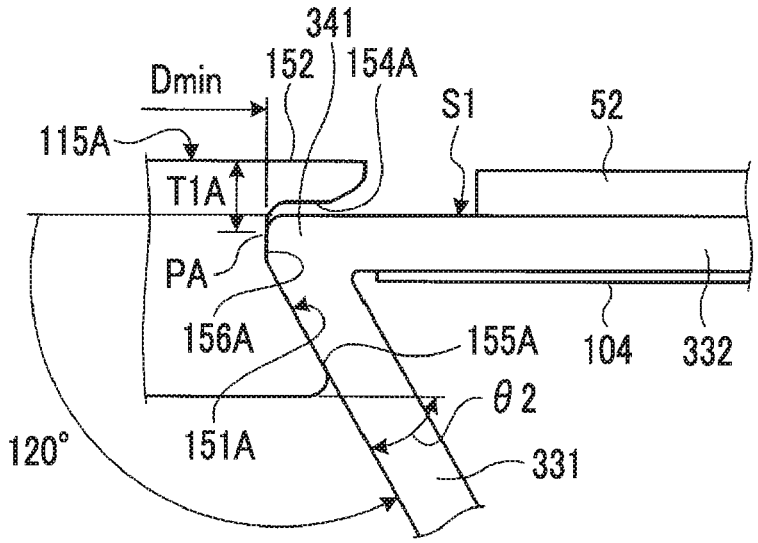
Figures 2, 8:
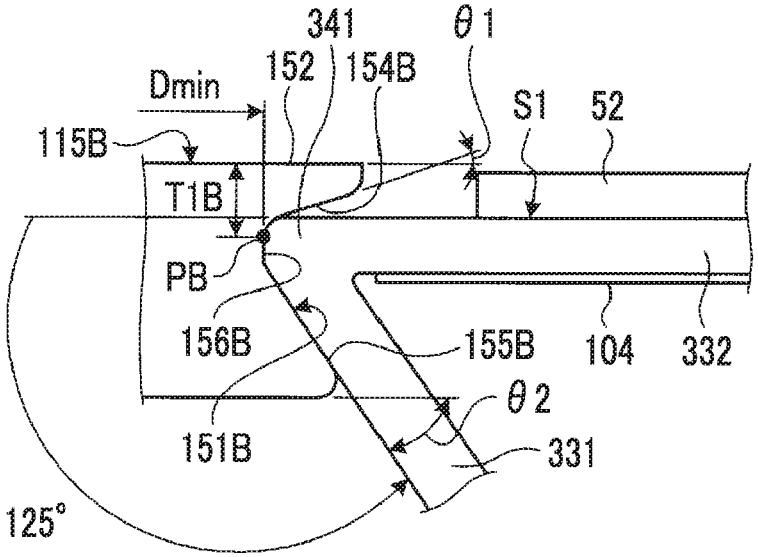
Figures 3, 8:
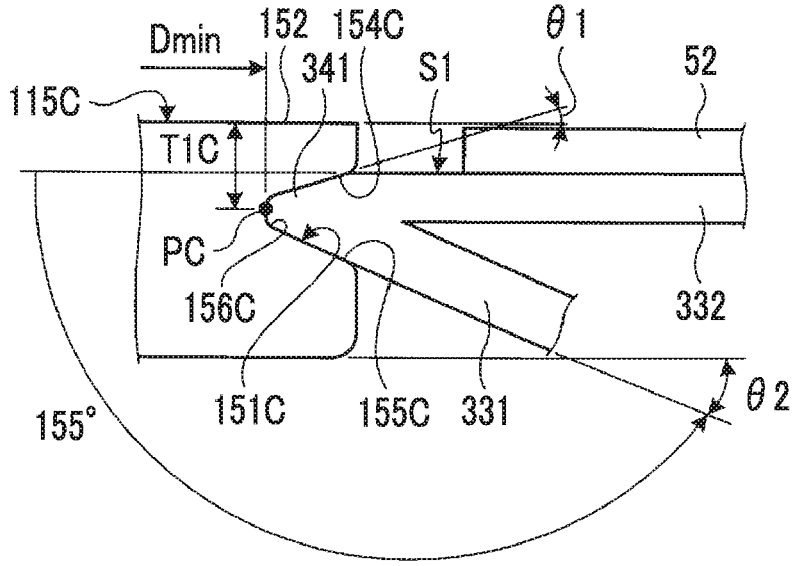
Figures 4, 8:
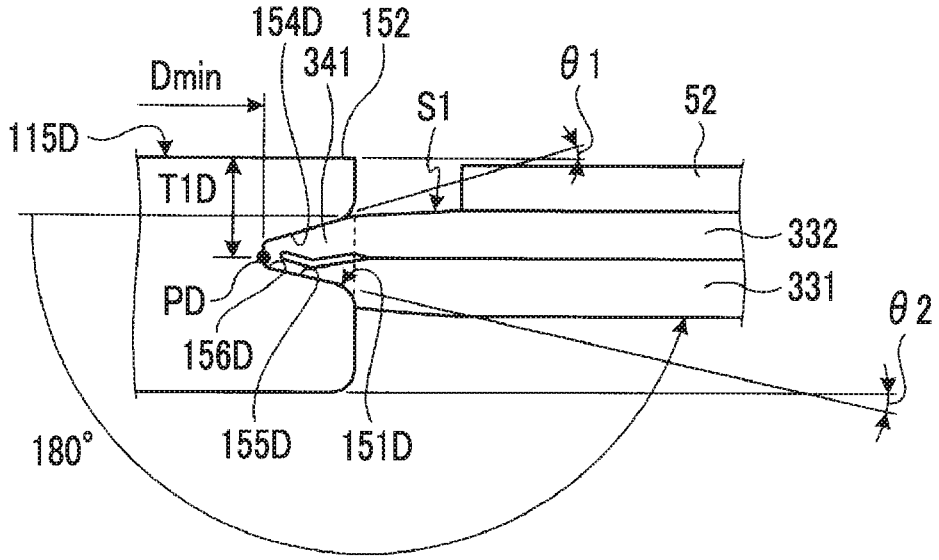
Figures 1, 9:
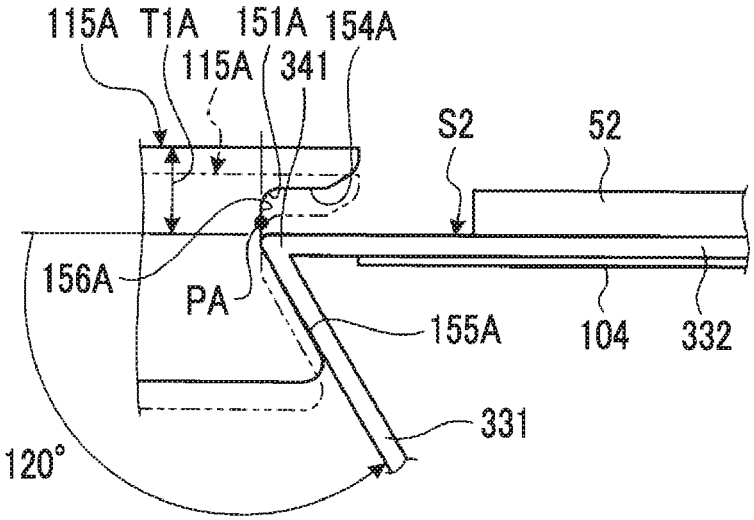
Figures 2, 9:
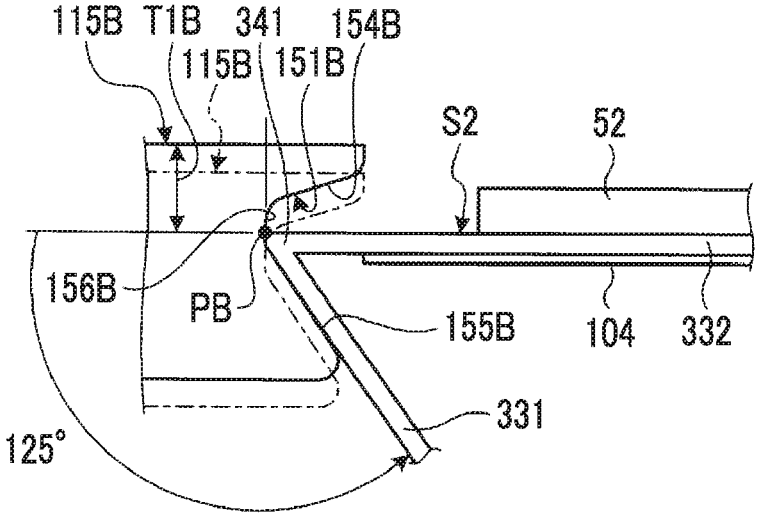
Figures 3, 9:
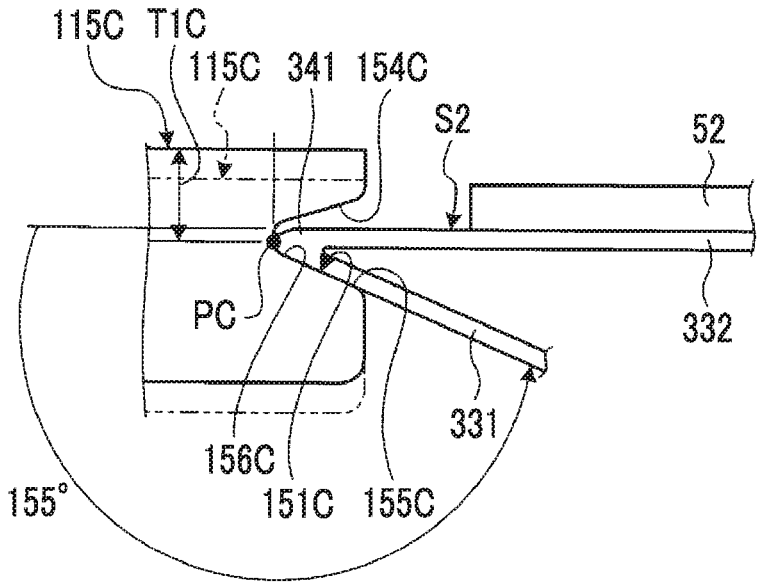
Figures 4, 9:
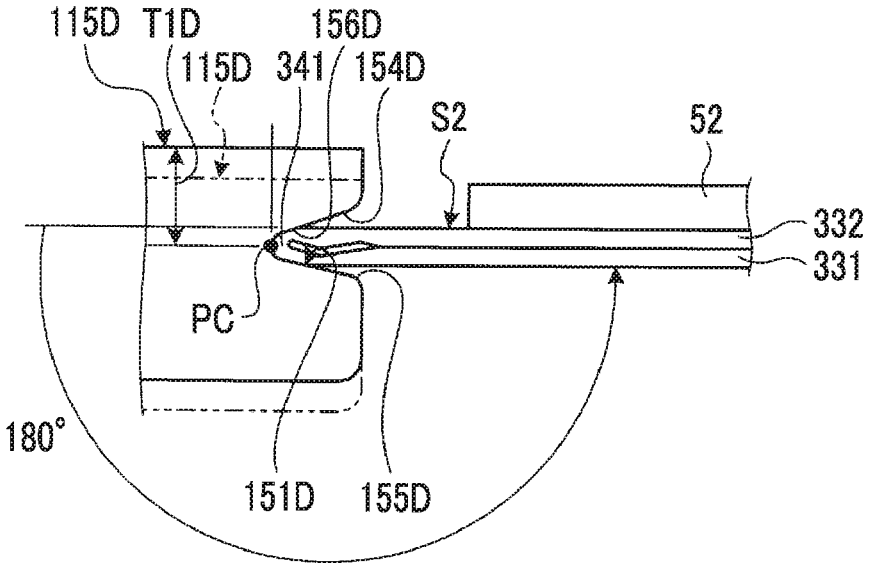

Hereinafter, a detail shape of the second gauge roller 115 will be described. FIG. 7 is an explanatory view for explaining the shape of the second gauge roller, FIGS. 8-1 to 8-4 are schematic views showing a shape change of the second gauge roller when a thick sheet is folded, and FIGS. 9-1 to 9-4 are schematic views showing a shape change of the second gauge roller when a thin sheet is folded.

As shown in FIG. 7, in the second gauge roller 115, the rotation axis O is disposed in the vertical direction, an upper surface 152 and a lower surface 153 are planes and parallel to each other, and the second gauge roller 115 is provided along the horizontal direction orthogonal to the rotation axis O. Moreover, in the second gauge roller 115, the recessed portion 151 is provided on the outer peripheral surface between the upper surface 152 and the lower surface 153 along the circumferential direction. The recessed portion 151 includes an upper support surface 154, a lower support surface 155, and a deepest support surface 156 which connects the upper support surface 154 and the lower support surface 155 to each other, and in a side view of the second gauge roller 115, the recessed portion 151 has a substantially triangular shape which spreads up and down from the rotation axis O toward the outer peripheral surface side. In the present embodiment, the upper support surface 154 and the lower support surface 155 are planes along the radial direction, and the deepest support surface 156 is a curved surface which connects end portions of the upper support surface 154 and the lower support surface 155 on the rotation axis O side. In addition, in the second gauge roller 115, an outer peripheral upper end surface 157 and an outer peripheral lower end surface 158 are provided on the upper surface 152 side and the lower surface 153 side, the outer peripheral upper end surface 157 is continuous via the upper support surface 154, the upper surface 152, and curved portions 159 and 160, and the outer peripheral lower end surface 158 is continuous via the lower support surface 155, the lower surface 153, and curved portions 161 and 162.

Moreover, the second gauge roller 115 is not limited to the above-described shape. For example, the rotation axis O of the second gauge roller 115 may be disposed to be inclined by a predetermined angle with respect to the vertical direction. Further, in the second gauge roller 115, the upper surface 152 and the lower surface 153 may be formed to be uneven, or each of the upper surface 152 and the lower surface 153 may be a curved surface having a recessed shape. Moreover, the deepest support surface 156 is not limited to a curved surface shape, but may be a square shape or a planar shape. In addition, preferably, each of the outer peripheral upper end surface 157 and the outer peripheral lower end surface 158 has a planar shape or a curved surface shape, and is smoothly continuous with the upper support surface 154 and the lower support surface or the upper surface 152 and the lower surface.

In the present embodiment, the second gauge roller group 106 includes 11 second gauge rollers 115 (refer to FIG. 2). However, the number of the second gauge rollers 115 is not limited to this number. The number of second gauge rollers 115 constituting the second gauge roller group 106 may be appropriately set according to a type of corrugated board S or the like. Moreover, the several second gauge rollers 115 are arranged along the transfer direction D of the corrugated board S, the upper support surface 154 of each of a second gauge roller 115 on the most upstream side and several second gauge rollers 115 from the most upstream side is set to a horizontal surface, and the upper support surface 154 of each of intermediate second gauge rollers 115 is set to an inclined surface. A position at which the upper support surface 154 transitions from the horizontal surface to the inclined surface is a position at which the bending angles of both the end portions in the width direction in the corrugated board S are a predetermined angles (for example, a range of 60° to 70° greater than 90°. Moreover, an inclination angle of the upper support surface 154 is set to a constant angle.

Hereinafter, the shapes of the several second gauge rollers 115 will be specifically described below. In the second gauge roller 115, the recessed portion 151 is provided between the upper surface 152 and the lower surface 153, a position of the outer peripheral upper end surface 157 is a maximum outer diameter Dmax, and a bottom portion of the recessed portion 151 is a minimum outer diameter Dmin. Accordingly, the deepest position P of the recessed portion 151 is a position of the recessed portion 151 closest to the rotation axis O and is the position of the minimum diameter Dmin in the bottom portion of the recessed portion 151. Moreover, in the second gauge roller 115, a length (height) in the direction of the rotation axis O is T, and the deepest position P is a position of a length T1 along the direction of the rotation axis O from the upper surface 152. Moreover, the position of the deepest position P in the direction of the rotation axis O is defined if the deepest support surface 156 is a curved surface shape. However, if the deepest support surface 156 has a planar shape, the position of the deepest position P is an intermediate position of a planar portion in the direction of the rotation axis O, or an intermediate position of a straight line which connects a connection point (inflection point) between the deepest support surface 156 and the upper support surface 154 and a connection point (inflection point) between the deepest support surface 156 and the lower support surface 155 to each other and is positioned along the direction of the rotation axis O. Moreover, an inclination angle θ1 of the upper support surface 154 in the recessed portion 151 is an angle between the upper surface 152 and the upper support surface 154, and an inclination angle θ2 of the lower support surface 155 in the recessed portion 151 is an angle between the lower surface 153 and the lower support surface 155. Moreover, when the upper support surface 154 is a plane, the inclination angle thereof is an angle along the plane, and when the upper support surface 154 is a curved surface, the inclination angle thereof is an angle along a straight line which connects a connection point (inflection point) between the upper support surface 154 and the deepest support surface 156 and a connection point (inflection point) between the upper support surface 154 and the curved portion 159 on the upper surface 152 side to each other. Moreover, the same is applied to the lower support surface 155.

As shown in FIG. 8-1, an Nth second gauge roller 115A from the most upstream side in a transfer direction of a thick corrugated board S1 has a recessed portion 151A including an upper support surface 154A, a lower support surface 155A, and a deepest support surface 156A. The second gauge roller 115A supports the outer peripheral portion of the bent portion 341 by the recessed portion 151A when the sheet piece 331 on the end portion side in the width direction is bent to about 120° with respect to the sheet piece 332 on the center side in the width direction of the corrugated board S1. Here, in the recessed portion 151A of the second gauge roller 115A, the upper support surface 154A is set to a horizontal surface having the inclination angle θ1=0°, and the lower support surface 155A is set to an inclined surface having an inclination angle θ2=60°. Moreover, a deepest position PA is a position having a length T1A from the upper surface 152. In this case, the outer peripheral portion of the bent portion 341 of the corrugated board S1 is in contact with the deepest support surface 156A of the recessed portion 151A and the position in the width direction of the corrugated board S1 is regulated. Moreover, the sheet piece 331 is in contact with the lower support surface 155A whose outer surface is an inclined surface and is supported by the lower support surface 155A.

As shown in FIG. 8-2, an Nth+1 second gauge roller 115B from the most upstream side in the transfer direction of the corrugated board S1 has a recessed portion 151B including an upper support surface 154B, a lower support surface 155B, and a deepest support surface 156B. The second gauge roller 115B supports the outer peripheral portion of the bent portion 341 by the recessed portion 151B when the sheet piece 331 on the end portion side in the width direction is bent to about 125° with respect to the sheet piece 332 on the center side in the width direction of the corrugated board S1. Here, in the recessed portion 151B of the second gauge roller 115B, the upper support surface 154B is set to an inclined surface having the inclination angle θ1=20°, and the lower support surface 155B is set to an inclined surface having an inclination angle θ2=55°. Moreover, a deepest position PB is a position having a length T1B (T1A<T1B) longer than the length T1A from the upper surface 152. In this case, the outer peripheral portion of the bent portion 341 of the corrugated board S1 is supported by the deepest support surface 156B of the recessed portion 151B, and thus, movements in the width direction and the thickness direction (up-down direction) of the corrugated board S1 are regulated. Moreover, the sheet piece 331 is supported by the lower support surface 155B whose outer surface is an inclined surface.

As shown in FIG. 8-3, an Nth+7 second gauge roller 115C from the most upstream side in the transfer direction of the corrugated board S1 has a recessed portion 151C including an upper support surface 154C, a lower support surface 155C, and a deepest support surface 156C. The second gauge roller 115C supports the outer peripheral portion of the bent portion 341 by the recessed portion 151C when the sheet piece 331 on the end portion side in the width direction is bent to about 155° with respect to the sheet piece 332 on the center side in the width direction of the corrugated board S1. Here, in the recessed portion 151C of the second gauge roller 115C, the upper support surface 154C is set to an inclined surface having the inclination angle θ1=20°, and the lower support surface 155C is set to an inclined surface having an inclination angle θ2-20°. Moreover, a deepest position PC is a position having a length T1C (T1B<T1C) longer than the length T1B from the upper surface 152. In this case, the outer peripheral portion of the bent portion 341 of the corrugated board S1 is supported by the deepest support surface 156C of the recessed portion 151C, and thus, movements in the width direction and the thickness direction (up-down direction) of the corrugated board S1 are regulated. Moreover, the sheet piece 332 is supported by the upper support surface 154C whose outer surface is an inclined surface, and the sheet piece 331 is supported by the lower support surface 155C whose outer surface is an inclined surface.

As shown in FIG. 8-4, a second gauge roller 115D on the most downstream side in the transfer direction of the corrugated board S1 has a recessed portion 151D including an upper support surface 154D, a lower support surface 155D, and a deepest support surface 156D. The second gauge roller 115D supports the outer peripheral portion of the bent portion 341 by the recessed portion 151D when the sheet piece 331 on the end portion side in the width direction is bent to about 180° with respect to the sheet piece 332 on the center side in the width direction of the corrugated board S1. Here, in the recessed portion 151D of the second gauge roller 115D, the upper support surface 154D is set to an inclined surface having the inclination angle θ1=20°, and the lower support surface 155D is set to an inclined surface having an inclination angle θ2=15°. Moreover, a deepest position PD is a position having a length T1D (T1C<T1D) longer than the length T1C from the upper surface 152. In this case, the outer peripheral portion of the bent portion 341 of the corrugated board S1 is supported by the deepest support surface 156D of the recessed portion 151D, and thus, movements in the width direction and the thickness direction (up-down direction) of the corrugated board S1 are regulated. In addition, the sheet piece 332 is supported by the upper support surface 154D whose outer surface is an inclined surface, and the sheet piece 331 is supported by the lower support surface 155D whose outer surface is an inclined surface.

As shown in FIGS. 8-1 to FIG. 8-4, in the several second gauge rollers 115 (115A, 115B, 115C, 115D) disposed along the transfer direction D of the corrugated board S1, the recessed portions 151 (151A, 151B, 151C, 151D) are respectively provided on the outer peripheral surfaces of the second gauge rollers 115. The positions of the recessed portions 151 (151A, 151B, 151C, 151D) in the direction of the rotation axis O at the deepest positions P (PA, PB, PC, PD) are disposed to be offset downward by a predetermined length toward the downstream side in the transfer direction D of the corrugated board S1. Specifically, in the several second gauge rollers 115 (115A, 115B, 115C, 115D), the upper support surfaces 154 (154A, 154B, 154C, 154D) transition from the horizontal surfaces to the inclined surfaces from a position of a predetermined angle at which the bending angle of the corrugated board S is larger than 90°.

Accordingly, when the sheet pieces 331 and 334 on the end portion sides in width direction of the corrugated board S are bent, the bent portions 341 and 342 are supported by the second gauge roller 115 having the recessed portion 151 whose upper support surface 154 is the horizontal surface up to the bending angle of 120°, and after the bending angle of 125°, the bent portions 341 and 342 are supported by the second gauge roller 115 having the recessed portion 151 whose upper support surface 154 is the inclined surface. The medium forming the waveform is interposed between the front liner and the top liner, and thus, the corrugated board S is formed. In addition, when the corrugated board S is bent at the positions of the creasing lines 312 and 314, the medium is crushed from about 90 in the bending angle. When the medium is crushed, the positions of the bent portions 341 and 342 vary in the thickness direction of the corrugated board S. Meanwhile, in the present embodiment, while the corrugated board S is bent, variations in the positions of the bent portions 341 and 342 in the thickness direction of the corrugated board S are suppressed after the bent portions 341 and 342 are supported by the deepest support surface 156 located between the respective support surfaces 154 and 155 having an inclined shape. Accordingly, the position of each of the bent portions 341 and 342 is an intermediate position in the thickness direction of the corrugated board S, and in the corrugated box B folded to have a flat shape, the gaps of the distal end portions of the sheet pieces 331 and 334 on the end portion sides in the width direction are constant, and thus, quality of the corrugated box B is improved.

Moreover, the position at which the upper support surface 154 of the recessed portion 151 of the second gauge roller 115 transitions from the horizontal surface to the inclined surface is the position at which the bending angle is 120° to 125°, but is not limited to the position. The position at which the upper support surface 154 transitions from the horizontal surface to the inclined surface may be a position at which the bending angle is an angle smaller than 120° or may be a position at which the bending angle is a position at which the bending angle is an angle larger than 125°. However, it is preferable that the bending angle is within a region of 120° to 160°. In this case, it is desirable that the position at which the upper support surface 154 transitions from the horizontal surface to the inclined surface is a region having a smaller bending angle as the thickness of the corrugated board S is thinner.

The several corrugated boards S have different thicknesses, and the sheet folding device of the present embodiment is compatible with several types of corrugated board S having different thicknesses. As described above, the sheet folding device of the present embodiment has the gauge roller vertical adjustment device 126 which adjusts the position (height in vertical direction) of the second gauge roller 115 in the rotation axis direction. The gauge roller vertical adjustment device 126 adjusts the position of each second gauge roller 115 upward in the vertical direction as the thickness of the corrugated board S decreases.

As shown in FIG. 9-1, the Nth second gauge roller 115A from the most upstream side in a transfer direction of a thin corrugated board S2 has the recessed portion 151A including the upper support surface 154A, the lower support surface 155A, and the deepest support surface 156A. The second gauge roller 115A supports the outer peripheral portion of the bent portion 341 by the recessed portion 151A when the sheet piece 331 on the end portion side in the width direction is bent to about 120° with respect to the sheet piece 332 on the center side in the width direction of the corrugated board S2. A position of the second gauge roller 115A (solid line in FIG. 9-1) supporting the thin corrugated board S2 is changed upward by a predetermined length from a position of the second gauge roller 115A (two-dot chain line of FIG. 9-1) supporting the thick corrugated board S2 by the gauge roller vertical adjustment device 126. In this case, the outer peripheral portion of the bent portion 341 of the corrugated board S2 is in contact with the deepest support surface 156A of the recessed portion 151A and the position in the width direction of the corrugated board S2 is regulated. In this case, the sheet piece 331 is supported by the lower support surface 155A whose outer surface is an inclined surface.

As shown in FIG. 9-2, the Nth+1 second gauge roller 115B from the most upstream side in the transfer direction of the corrugated board S2 has the recessed portion 151B including the upper support surface 154B, the lower support surface 155B, and the deepest support surface 156B. The second gauge roller 115B supports the outer peripheral portion of the bent portion 341 by the recessed portion 151B when the sheet piece 331 on the end portion side in the width direction is bent to about 125° with respect to the sheet piece 332 on the center side in the width direction of the corrugated board S2. A position of the second gauge roller 115B (solid line in FIG. 9-2) supporting the thin corrugated board S2 is changed upward by a predetermined length from a position of the second gauge roller 115B (two-dot chain line of FIG. 9-2) supporting the thick corrugated board S2 by the gauge roller vertical adjustment device 126. In this case, the outer peripheral portion of the bent portion 341 of the corrugated board S2 is in contact with the deepest support surface 156B of the recessed portion 151B, and thus, the position in the width direction of the corrugated board S2 is regulated. Moreover, the sheet piece 331 is continuously supported by the lower support surface 155B whose outer surface is an inclined surface.

As shown in FIG. 9-3, the Nth+7 second gauge roller 115C from the most upstream side in the transfer direction of the corrugated board S2 has a recessed portion 151C including the upper support surface 154C, the lower support surface 155C, and the deepest support surface 156C. The second gauge roller 115C supports the outer peripheral portion of the bent portion 341 by the recessed portion 151C when the sheet piece 331 on the end portion side in the width direction is bent to about 155° with respect to the sheet piece 332 on the center side in the width direction of the corrugated board S2. A position of the second gauge roller 115C (solid line in FIG. 9-3) supporting the thin corrugated board S2 is changed upward by a predetermined length from a position of the second gauge roller 115C (two-dot chain line of FIG. 9-3) supporting the thick corrugated board S2 by the gauge roller vertical adjustment device 126. In this case, the outer peripheral portion of the bent portion 341 of the corrugated board S2 is supported by the deepest support surface 156C of the recessed portion 151C, and thus, movements in the width direction and the thickness direction (up-down direction) of the corrugated board S2 are regulated. Moreover, the sheet piece 331 is continuously supported by the lower support surface 155C whose outer surface is an inclined surface.

As shown in FIG. 9-4, the second gauge roller 115D on the most downstream side in the transfer direction of the corrugated board S2 has a recessed portion 151D including the upper support surface 154D, the lower support surface 155D, and the deepest support surface 156D. The second gauge roller 115D supports the outer peripheral portion of the bent portion 341 by the recessed portion 151D when the sheet piece 331 on the end portion side in the width direction is bent to about 180° with respect to the sheet piece 332 on the center side in the width direction of the corrugated board S2. A position of the second gauge roller 115D (solid line in FIG. 9-4) supporting the thin corrugated board S2 is changed upward by a predetermined length from a position of the second gauge roller 115D (two-dot chain line of FIG. 9-4) supporting the thick corrugated board S2 by the gauge roller vertical adjustment device 126. In this case, the outer peripheral portion of the bent portion 341 of the corrugated board S2 is supported by the deepest support surface 156D of the recessed portion 151D, and thus, movements in the width direction and the thickness direction (up-down direction) of the corrugated board S2 are regulated. Moreover, the sheet piece 332 is continuously supported by the upper support surface 154D whose outer surface is an inclined surface, and the sheet piece 331 is continuously supported by the lower support surface 155D whose outer surface is an inclined surface.

As shown in FIGS. 9-1 to 9-4, in the several second gauge rollers 115 (115A, 115B, 115C, 115D), the upper support surfaces 154 (154A, 154B, 154C, 154D) transition from the horizontal surfaces to the inclined surfaces from a position of a predetermined angle at which the bending angle of the corrugated board S2 is larger than 90°. In addition, the positions of the several second gauge rollers 115 (115A, 115B, 115C, 115D) are adjusted upward in the vertical direction by the gauge roller vertical adjustment device 126 as the thickness of the corrugated board S decreases.

Accordingly, based on the thick corrugated board S1, the several second gauge rollers 115 are disposed upward by the thin corrugated board S2, and after the bending angle is 125°, the bent portions 341 and 342 are supported by the second gauge roller 115 having the recessed portion 151 whose upper support surface 154 is an inclined surface. Accordingly, the bent portion 341 and 342 of the corrugated board S are appropriately supported by the deepest support surfaces 156 of the recessed portions 151 regardless of the thickness of the corrugated board S, and variations in the positions of the bent portions 341 and 342 in the thickness direction of the corrugated board S are suppressed. Therefore, the position of each of the bent portions 341 and 342 is an intermediate position in the thickness direction of the corrugated board S, and in the corrugated box B folded to have a flat shape, the gaps of the distal end portions of the sheet pieces 331 and 334 on the end portion sides in the width direction are constant, and thus, the quality of the corrugated box B is improved. In FIGS. 9-1 to 9-3, the outer surface of the sheet piece 332 is not sufficiently in contact with the upper support surfaces 154A, 154B, and 154C. However, in the thin corrugated board S2, the medium forming the waveform has a fine pitch. Accordingly, the outer peripheral portion of the bent portion 341 is supported by the deepest support surface 156D of the recessed portions 151A, 151B, 151, and thus, the bent portion 341 is bent at an appropriate position.

Figures 1, 10:
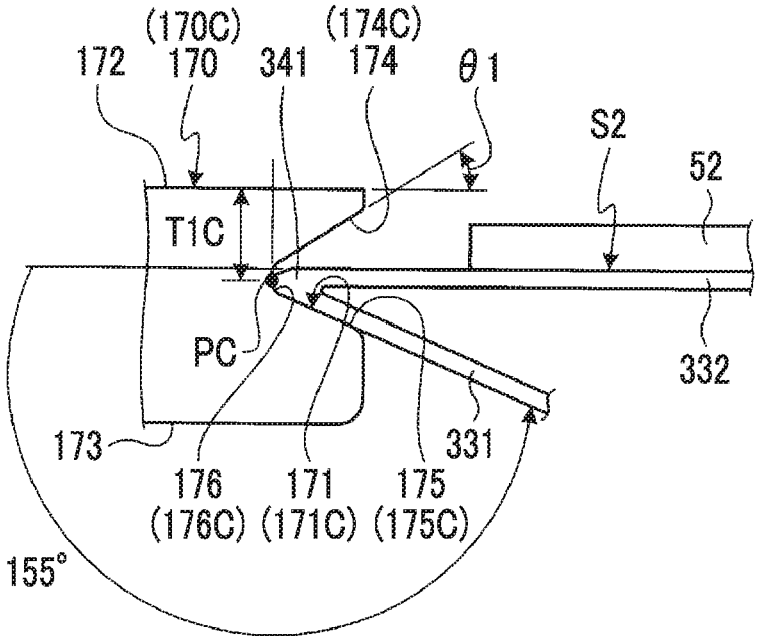
Figures 2, 10:
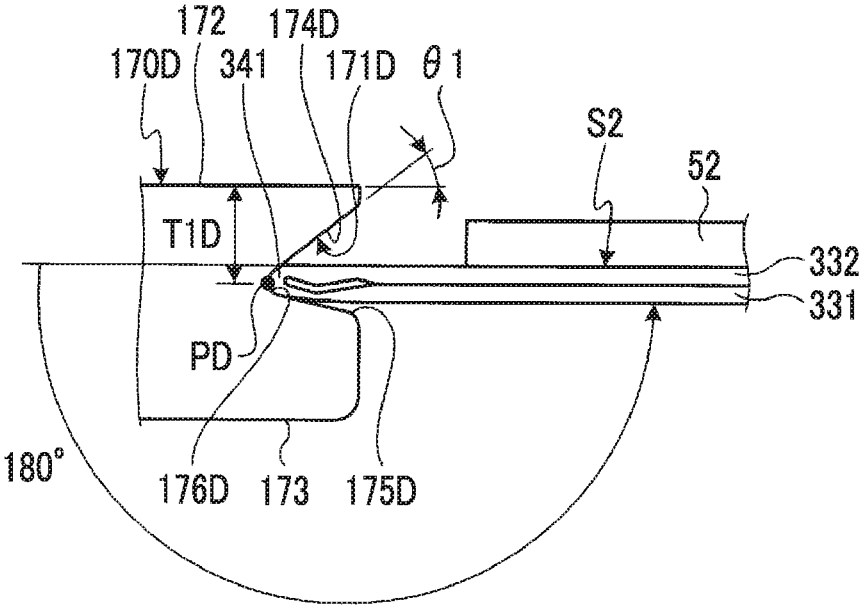

Moreover, in the above-described embodiment, in each of the several second gauge rollers 115, the upper support surface 154 transitions from the horizontal surface to the inclined surface from the position of the predetermined angle at which the bending angle of the corrugated board S is smaller than 90°, and the inclination angle of the upper support surface 154 is set to a constant angle. However, the present invention is not limited to this configuration. FIGS. 10-1 and 10-2 are schematic views showing a modification example of the shape change of the second gauge roller when the sheet is folded. Here, a case where the modification example is applied to the thin corrugated board S2 is described. However, the modification example can be also applied to the thick corrugated board S1.

As shown in FIG. 9-2, the Nth+1 second gauge roller 115B from the most upstream side in the transfer direction of the corrugated board S2 has the recessed portion 151B including the upper support surface 154B, the lower support surface 155B, and the deepest support surface 156B. The second gauge roller 115B supports the outer peripheral portion of the bent portion 341 by the recessed portion 151B when the sheet piece 331 on the end portion side in the width direction is bent to about 125° with respect to the sheet piece 332 on the center side in the width direction of the corrugated board S2. Here, in the recessed portion 151B of the second gauge roller 115B, the upper support surface 154B is set to the inclined surface having the inclination angle θ1=20°. Moreover, the deepest position PB is set so as to have a relationship of T1A<T1B.

As shown in FIG. 10-1, in an Nth+7 second gauge roller 170 (170C) from the most upstream side in the transfer direction of the corrugated board S2, a recessed portion 171 (171C) is provided between an upper surface 172 and a lower surface 173, and the recessed portion 171 (171C) includes an upper support surface 174 (174C), a lower support surface 175 (175C), and a deepest support surface 176 (176C). The second gauge roller 170C supports the outer peripheral portion of the bent portion 341 by the recessed portion 171C when the sheet piece 331 on the end portion side in the width direction is bent to about 155° with respect to the sheet piece 332 on the center side in the width direction of the corrugated board S2. Here, in the recessed portion 171C of the second gauge roller 170C, the upper support surface 174C is set to an inclined surface having the inclination angle θ1=35°. Moreover, the deepest position PC is set to have the relationship of T1B<T1C. In this case, the outer peripheral portion of the bent portion 341 of the corrugated board S2 is supported by the deepest support surface 176C of the recessed portion 171C, and thus, the movements in the width direction and the thickness direction (up-down direction) of the corrugated board S2 are regulated. In this case, the sheet piece 331 is supported by the lower support surface 175C whose outer surface is an inclined surface.

As shown in FIG. 10-2, a second gauge roller 170D on the most upstream side in the transfer direction of the corrugated board S2 has a recessed portion 171D including an upper support surface 174D, a lower support surface 175D, and a deepest support surface 176D. The second gauge roller 170D supports the outer peripheral portion of the bent portion 341 by the recessed portion 171D when the sheet piece 331 on the end portion side in the width direction is bent to about 180° with respect to the sheet piece 332 on the center side in the width direction of the corrugated board S2. Here, in the recessed portion 171D of the second gauge roller 170D, the upper support surface 174D is set to an inclined surface having the inclination angle θ1=45°. Moreover, the deepest position PD is set to have the relationship of T1C<T1D. In this case, the outer peripheral portion of the bent portion 341 of the corrugated board S2 is supported by the deepest support surface 176D of the recessed portion 171D, and thus, the movements in the width direction and the thickness direction (up-down direction) of the corrugated board S2 are regulated. In this case, the sheet piece 331 is supported by the lower support surface 175D whose outer surface is an inclined surface.

As shown in FIG. 9-2, FIG. 10-1, and FIG. 10-2, in the several second gauge rollers 115B, 170C, and 170D disposed along the transfer direction D of the corrugated board S2, the recessed portions 151B, 171C, 171D are respectively provided on the outer peripheral surfaces of the second gauge rollers. The positions of the recessed portions 151B, 171C, 171D in the direction of the rotation axis O at the deepest positions P (PB, PC, PD) are disposed to be offset downward by a predetermined length toward the downstream side in the transfer direction D of the corrugated board S2. Specifically, in the several second gauge rollers 115B, 170C, 170D, angles of the inclined surfaces of the upper support surfaces 154B, 174C, and 174D are set to gradually increase toward the downstream side in the transfer direction of the corrugated board S from a position of a predetermined angle at which the bending angle of the corrugated board S is larger than 90°.

Accordingly, when the sheet pieces 331 and 334 on the end portion sides in width direction of the corrugated board S are bent, after the bending angle of 125°, the bent portions 341 and 342 are supported by the second gauge rollers 115B, 170C, and 170D having the recessed portion 151B, 171C, and 171D whose upper support surfaces 154B, 174C, and 174D are the inclined surfaces. In the present embodiment, while the corrugated board S is bent, the bent portions 341 and 342 are supported by the deepest support surfaces 156B, 176C, and 176D continuous to the upper support surfaces 154B, 174C, and 174D whose inclination angles gradually increase, and thus, variations in the positions of the bent portions 341 and 342 in the thickness direction of the corrugated board S are suppressed. Accordingly, the position of each of the bent portions 341 and 342 is the intermediate position in the thickness direction of the corrugated board S, and in the corrugated box B folded to have a flat shape, the gaps of the distal end portions of the sheet pieces 331 and 334 on the end portion sides in the width direction are constant, and thus, quality of the corrugated box B is improved.

Therefore, in the sheet folding device of the present embodiment, the sheet folding device includes the forming belts 107 which are disposed on both the sides in the transfer direction D of the corrugated board S and move to the center side in the width direction of the corrugated board S toward the downstream side in the transfer direction D of the corrugated board S to press both the end portions in the width direction of the corrugated board S from an outside so as to bend both the end portions, and gauge roller groups 105 and 106 including several gauge rollers 114, 115, and 170 which are disposed along the transfer direction D of the corrugated board S and come into contact with outer sides of both the bent portions 341 and 342 in the width direction of the corrugated board S bent by the forming belts 107, in which in the several second gauge rollers 115 and 170, the recessed portions 151 and 171 recessed toward the rotation axis side in the radial direction are provided on the outer peripheral surfaces of the gauge rollers 115 and 170 in the circumferential direction, and the positions of the recessed portions 151 and 171 in the direction of the rotation axis O at the deepest positions P are disposed to be offset downward in the vertical direction toward a downstream side in the transfer direction D of the corrugated board S.

Accordingly, the forming belts 107 move to the center side in the width direction toward the downstream side in the transfer direction D of the corrugated board S, both the end portions in the width direction of the corrugated board S are pressed from the outside to be bent, and the several gauge rollers 114, 115, and 170 support both the bent portions 341 and 342 in the width direction of the corrugated board S. In this case, while the corrugated board S is bent, the positions of the bent portions 341 and 342 are supported by the recessed portions 151 and 171. Accordingly, the variation in the thickness direction suppressed, the center positions of the bent portions 341 and 342 in the thickness direction move downward, and thus, the bent portions 341 and 342 are formed to be located at appropriate positions. Therefore, in the corrugated board S, the positions of the bent portions 341 and 342 are close to the intermediate positions in the thickness direction, the corrugated board S is bent at an appropriate position, and thus, it is possible to improve bending accuracy of the corrugated board.

In the sheet folding device according of the present embodiment, the recessed portions 151 and 171 have the upper support surface 154 and 174, the lower support surfaces 155 and 175, and the deepest support surfaces 156 and 176 which connect the upper support surfaces 154 and 174 and the lower support surfaces 155 and 175 to each other, and the upper support surface 154 and 174 transition from the horizontal surfaces along the horizontal direction to the inclined surfaces inclined with respect to the horizontal direction at the predetermined transition position at which the bending angles of both the end portions in the width direction of the corrugated board S are angles larger than 90°. Therefore, in the corrugated board S, the bent portions 341 and 342 come into contact with the inclined upper support surfaces 154 and 174 to be supported at the predetermined transition position at which the bending angles of both the end portions are the angle larger than 90°. Accordingly, the center positions of the bent portions 341 and 342 in the thickness direction are regulated to gradually move downward, and thus, the bent portions 341 and 342 can be formed at the appropriate positions.

In the sheet folding device of the present embodiment, in the second gauge roller 115 which is disposed on the downstream side in the transfer direction D of the corrugated board S from the predetermined transition position, the inclination angle the upper support surface 154 which is the inclined surface is set to a constant angle. Accordingly, the inclination angles of the upper support surfaces 154 of the second gauge rollers 115 disposed on the downstream side from the transition position are the same as each other, and thus, the contact angles with respect to the outer peripheral surfaces of the bent portion 341 and 342 in the corrugated board S are constant, and the bent portion 341 and 342 can be formed to have the appropriate shapes.

In the sheet folding device of the present embodiment, in the second gauge roller 170 which is disposed on the downstream side in the transfer direction D of the corrugated board S from the predetermined transition position, the inclination angle of the upper support surface 174 which is the inclined surface is set so as to gradually increases. Accordingly, the inclination angle of the upper support surface 174 of the second gauge roller 170 which is disposed on the downstream side from the transition position has the angle which gradually increases, and thus, the center positions in the thickness direction of the bent portions 341 and 342 in the corrugated board S are gradually regulated to be the appropriate positions, and the bent portions 341 and 342 can be formed in the appropriate shapes.

In the sheet folding device of the present embodiment, the deepest support surfaces 156 and 176 have the curved surface shape. Accordingly, the recessed portions 151 and 171 in the second gauge rollers 115 and 170 can support the bent portions 341 and 342 in the corrugated board S, the bent portions 341 and 342 can be supported by the deepest support surfaces 156 and 176 without a gap, and the bent portions 341 and 342 can be formed in the appropriate shapes.

The sheet folding device of the present embodiment includes the gauge roller vertical adjustment device 126 which adjusts the positions of the several gauge rollers 114, 115, and 170 in the direction of the rotation axis O. Accordingly, the gauge rollers 114, 115, and 170 can be adjusted in the direction of the rotation axis O by the gauge roller vertical adjustment device 126. Therefore, the position of the recessed portions 151 and 171 in the gauge rollers 114, 115, and 170 can be adjusted to be the appropriate positions according to a type of the corrugated board S, and the bent portions 341 and 342 can be formed in the appropriate shapes regardless of the type of the corrugated board S.

In the sheet folding device of the present embodiment, the gauge roller vertical adjustment device 126 adjusts the positions of the gauge rollers 115 and 170 upward in the vertical direction in the direction of the rotation axis O as a thickness of the corrugated board S decreases. Accordingly, the position of the second gauge rollers 115 and 170 can be adjusted upward in the vertical direction as the thickness of the corrugated board S decreases. Therefore, when the corrugated board S is bent, the recessed portions 151 and 171 of the second gauge rollers 115 and 170 can appropriately support the lower surface of the bent portions 341 and 342 in the corrugated board S, and the bent portions 341 and 342 can be formed in the appropriate shapes.

Moreover, in the carton-forming machine of the present embodiment, the sheet feeding section 11, the printing section 21, the slotter creaser section 31, the die cutting section 41, the folding section 51, and the counter-ejector section 61 are provided, and the sheet folding device 55 is provided in the folding section 51. Accordingly, the printing is performed on the corrugated board S from the sheet feeding section 11 by the printing section 21, the creasing line processing and the slicing are performed by the slotter creaser section 31, the corrugated board S is folded by the folding section 51, the end portions of the corrugated board S are joined to each other to form the corrugated box B, and the corrugated boxes B are stacked while being counted by the counter-ejector section 61. In this case, in the sheet folding device 55, the forming belts 107 move to the center side in the width direction toward the downstream side in the transfer direction D of the corrugated board S, both the end portions in the width direction of the corrugated board S are pressed from the outside to be bent, and the several gauge rollers 114, 115, and 170 support both the bent portions 341 and 342 in the width direction of the corrugated board S. In this case, while the corrugated board S is bent, the positions of the bent portions 341 and 342 are supported by the recessed portions 151 and 171. Accordingly, the variation in the thickness direction suppressed, the center positions of the bent portions 341 and 342 in the thickness direction move downward, and thus, the bent portions 341 and 342 are formed to be located at the appropriate positions. Therefore, in the corrugated board S, the positions of the bent portions 341 and 342 is close to the intermediate position in the thickness direction, the corrugated board S is bent at the appropriate position, and thus, it is possible to improve the bending accuracy of the corrugated board S.

Moreover, in the above-described embodiment, each of the first folding rail adjustment devices 121, the second folding rail adjustment devices 122, the first gauge roller adjustment devices 123, the second gauge roller adjustment devices 124, the third gauge roller adjustment devices 125, and the gauge roller vertical adjustment devices 126 is an eccentric type device. However, the present invention is not limited to this configuration, and for example, a screw type device or a cylinder type device may be used.

Moreover, in the above-described embodiment, the folding rails 101 and 102, the guide plates 103 and 104, and the gauge roller groups 105 and 106 are respectively divided into two. However, the present invention is not limited to this configuration, the folding rails 101 and 102, the guide plates 103 and 104, and the gauge roller groups 105 and 106 may be respectively integrated with each other or may be respectively divided into three or more.

Moreover, in the above-described embodiment, the shape of the recessed portion in each gauge roller 115 is changed such that the deepest position of the recessed portion in each of the gauge rollers 115 and 170 is offset downward toward the downstream side in the transfer direction of the corrugated board S. However, the present invention is not limited to this configuration. In the present invention, the position in the direction of the rotation axis at the deepest position of the recessed portion is disposed to be offset downward in the vertical direction toward the downstream side on the transfer direction of the corrugated board, and thus, for example, the position of each gauge roller may be disposed to be offset downward toward the downstream side in the transfer direction of the corrugated board S.

In addition, in the above-described embodiment, the carton-forming machine 10 includes the sheet feeding section 11, the printing section 21, the slotter creaser section 31, the die cutting section 41, the folding section 51, and the counter-ejector section 61. However, the present invention is not limited to this configuration. For example, in a case where punching such as a hand hole is not necessary in the corrugated board S, the die cutting section 41 may not be provided.

REFERENCE SIGNS LIST

11: sheet feeding section
21: printing section
31: slotter creaser section
41: die cutting section
51: folding section
55: sheet folding device
61: counter-ejector section
101: first folding rail (folding rail)
102: second folding rail (folding rail)
103: first guide plate (guide plate)
104: second guide plate (guide plate)
105: first gauge roller group (gauge roller group)
106: second gauge roller group (gauge roller group)
107: forming belt
108: folding bar
114: first gauge roller
115, 115A, 115B, 115C, 115D, 170, 170C, 170D: second gauge roller
121: first folding rail adjustment device
122: second folding rail adjustment device
123: first gauge roller adjustment device
124: second gauge roller adjustment device
125: third gauge roller adjustment device
126: gauge roller vertical adjustment device (gauge roller adjustment device)
127: controller
151, 151A, 151B, 151C, 151D, 171, 171C, 171D: recessed portion
152, 172: upper surface
153, 173: lower surface
154, 154A, 154B, 154C, 154D, 174, 174C, 174D: upper support surface
155, 155A, 155B, 155C, 155D, 175, 175C, 175D: lower support surface
156, 156A, 156B, 156C, 156D, 176, 176C, 176D: deepest support surface
331, 334: sheet piece
332, 333: sheet piece
341, 342: bent portion
D: transfer direction
S, S1, S2: corrugated board
B: corrugated box

The invention claimed is:

1. A sheet folding device comprising:

forming belts which are disposed on both sides in a transfer direction of a corrugated board and move to a center side in a width direction of the corrugated board toward a downstream side in the transfer direction of the corrugated board to press both end portions in the width direction of the corrugated board from an outside so as to bend both the end portions;

a gauge roller group including several gauge rollers which are disposed along the transfer direction of the corrugated board and come into contact with outer sides of both bent portions in the width direction of the corrugated board bent by the forming belts; and a gauge roller adjustment device configured for moving the gauge roller group in parallel in a thickness direction of the corrugated board and adjusting a position of the gauge roller group in a direction of a rotation axis of the gauge rollers, wherein in the several gauge rollers, recessed portions recessed toward a rotation axis side in a radial direction are provided on outer peripheral surfaces of the gauge rollers in a circumferential direction, and positions of the recessed portions in the direction of the rotation axis at deepest positions are disposed to be offset downward in a vertical direction toward a downstream side in the transfer direction of the corrugated board, wherein each of the recessed portions has an upper support surface, a lower support surface, and a deepest support surface which connects the upper support surface and the lower support surface to each other, wherein the deepest support surface has a curved concave surface shape, and wherein the deepest support surface is configured to form the bent portions parallel to the transfer direction of the corrugated board, the deepest positions of the recessed portion being closest to the rotation axis of the gauge rollers.

2. The sheet folding device according to claim 1, wherein the upper support surface transitions from a horizontal surface along a horizontal direction to an inclined surface inclined with respect to the horizontal direction from a predetermined transition position at which bending angles of both the end portions in the width direction of the corrugated board are larger than 90°.

3. The sheet folding device according to claim 2, wherein in the gauge roller which is disposed on the downstream side in the transfer direction of the corrugated board from the predetermined transition position, an inclination angle of the inclined surface is set to a constant angle.

4. The sheet folding device according to claim 2, wherein in the gauge roller which is disposed on the downstream side in the transfer direction of the corrugated board from the predetermined transition position, an inclination angle of the inclined surface is set so as to gradually increase.

5. The sheet folding device according to claim 1, wherein the gauge roller adjustment device adjusts the positions of the several gauge rollers upward in the vertical direction in the direction of the rotation axis as a thickness of the corrugated board decreases.

6. A carton-forming machine comprising:

a sheet feeding section which supplies a corrugated board;

a printing section which performs printing on the corrugated board;

a slotter creaser section which performs creasing line processing and slicing on the printed corrugated board;

a folding section which has the sheet folding device according to claim 1; and a counter-ejector section which stacks flat corrugated boxes while counting the flat corrugated boxes, and thereafter, discharges the flat corrugated boxes every predetermined number.

* * * * *